US006149263A

United States Patent [19]

Nakano

[11] Patent Number: 6,149,263

[45] Date of Patent: Nov. 21, 2000

[54] INK JET RECORDING APPARATUS CAPABLE OF INCREASING A MONOCHROME PRINT SPEED WITHOUT CAUSING INK SUPPLY SHORTAGE TO AN IMAGE

[75] Inventor: Tomoaki Nakano, Kawasaki, Japan

[73] Assignee: Ricoh Company, Ltd., Tokyo, Japan

[21] Appl. No.: 08/969,025

[22] Filed: Nov. 12, 1997

[30] Foreign Application Priority Data

Nov. 13, 1996 [JP] Japan ..... 8-301902
Nov. 26, 1996 [JP] Japan ..... 8-314458

[51] Int. Cl.[7] ..... B41J 2/21; B41J 29/38

[52] U.S. Cl. ..... 347/43; 347/10; 347/11

[58] Field of Search ..... 347/43, 15, 17, 347/10, 41, 19, 11

[56] References Cited

U.S. PATENT DOCUMENTS

| | | | |
|---|---|---|---|
| 5,079,571 | 1/1992 | Eriksen | 347/43 |
| 5,220,342 | 6/1993 | Moriyama | 347/15 |
| 5,266,965 | 11/1993 | Komai et al. | 347/12 |
| 5,477,248 | 12/1995 | Sugimoto et al. | 347/43 |
| 5,900,891 | 5/1999 | Shimoda | 347/43 |
| 5,907,337 | 5/1999 | Tajika et al. | 347/40 |

FOREIGN PATENT DOCUMENTS 5527210 2/1980 Japan .

63260452 10/1988 Japan .

*Primary Examiner*—Thinh Nguyen
*Attorney, Agent, or Firm*—Cooper & Dunham LLP

[57] ABSTRACT

An ink jet recording apparatus capable of increasing a monochrome print speed without causing ink supply shortage to an image includes a carriage, a plurality of ink jet heads mounted on the carriage and including first, second, and successive ink jet heads for making dots in first, second, and successive colors, respectively. The ink jet recording apparatus further includes a head drive circuit for selectively driving the plurality of ink jet heads at a variable head drive frequency, a carriage drive circuit for driving the carriage at a variable carriage drive speed, a mode selecting circuit for selecting a multiple-head monochrome print mode in which a monochrome image is formed in such a way that a dot in the first color and at least one of dots in the second and successive colors are positioned in an alternating sequence, and a control circuit for controlling the head drive circuit to generate a monochrome image in the multiple-head monochrome mode and to adjust said variable head drive frequency from a first level to a different level which is equal to or lower than the first level and for controlling the carriage drive circuit to adjust said variable carriage drive speed from a first level to a different level which exceeds the first level, when the multiple-head monochrome print mode is selected by the mode selecting circuit.

17 Claims, 20 Drawing Sheets

$$2 \times D_p = 2 \times V_c \times 1/F_{max}$$

$2 \times D_p = 2 \times V_c \times 1/F_{max}$ $2 \times D_p = 2 \times V_c \times 1/F_{max}$ $2 \times D_p = 4 \times V_c \times 1/F_{max}$

Fig. 18

| ET | $B_k/B_{mix}$ | $V_p$ |
|---|---|---|
| 5 | $B_{mix}$ | 26 |
| 10 | $B_{mix}$ | 25 |
| 15 | $B_{mix}$ | 24 |
| 20 | $B_k$ | 24 |
| 25 | $B_k$ | 23 |
| 30 | $B_k$ | 23 |
| 35 | $B_k$ | 22 |
| 40 | $B_k$ | 22 |

Fig. 19

| ET | $SV_P3$ | $SV_P2$ | $SV_P1$ |
|---|---|---|---|
| 5 | 0 | 0 | 0 |
| 10 | 0 | 0 | 1 |
| 15 | 0 | 1 | 0 |
| 20 | 0 | 1 | 1 |
| 25 | 1 | 0 | 0 |
| 30 | 1 | 0 | 1 |
| 35 | 1 | 1 | 0 |
| 40 | 1 | 1 | 1 |

Fig. 20

| ET | SELECT |
|---|---|
| 5 | 0 |
| 10 | 0 |
| 15 | 0 |
| 20 | 1 |
| 25 | 1 |
| 30 | 1 |
| 35 | 1 |
| 40 | 1 |

$2 \times D_p = 2 \times V_c \times 1/F_{max}$ $2 \times D_p = 2 \times V_c \times 1/F_{max}$ $2 \times D_p = 4 \times V_c \times 1/F_{max}$

Fig. 24

| PRINT MODE | $B_k/B_{mix}$ | $V_c$ (mm/s) | F (kHz) |
|---|---|---|---|
| HIGH QUALITY | $B_K$ | 677 | 16 |
| HIGH SPEED | $B_{mix}$ | 1354 | 16 |

$2 \times D_p = 2 \times V_c \times 1/F_{max}$ $2 \times D_p = 4 \times V_c \times 1/F_{max}$

INK JET RECORDING APPARATUS CAPABLE OF INCREASING A MONOCHROME PRINT SPEED WITHOUT CAUSING INK SUPPLY SHORTAGE TO AN IMAGE

BACKGROUND OF THE INVENTION

1. Field of the Invention

The present invention relates to an ink jet head drive circuit and an ink jet recording apparatus, and more particularly to an ink jet head drive circuit and an ink jet recording apparatus capable of increasing a monochrome print speed without causing an ink supply shortage to an output image.

2. Discussion of the Background

Generally, when compared with printing devices such as dot matrix impact printers, etc., an ink jet recording apparatus produces substantially small amounts of vibrations and acoustic noises during its recording operations and is suitable for an application of color printing. This is a major reason that the ink jet recording apparatus has widely been adopted for use in various printing applications such as in a printer, a facsimile apparatus, a copying apparatus, and so forth.

The background ink jet recording apparatus is generally provided with a recording head unit that includes an ink cartridge and an ink jet head. The ink jet head includes a plurality of nozzles for discharging ink and a corresponding plurality of actuating elements, such as piezoelectric elements, exothermic reaction resisting elements, or so forth. The plurality of actuating elements provided inside the ink jet head are selectively driven with a signal that represents an image, so that a desired amount of ink can be discharged from the ink cartridge through the nozzles and fall onto a recording medium. In this way, the ink jet recording apparatus produces an output image on a recording medium.

The above-mentioned ink jet recording apparatus has lately been required to perform printing operations faster than ever. To respond to this requirement, techniques for driving the ink jet head at a high frequency have been developed, so that the ink jet recording apparatus can perform the printing operations faster than ever.

However, the characteristics of the ink discharge of an ink jet head may exert an effect on print quality. More specifically, one of the characteristics of the ink jet head is that an amount of ink to be discharged relates to a stability of an ink surface around the ink discharge orifice and the amount of ink discharged decreases when vibrations are caused on the ink surface. Since vibrations of the ink surface increase with an increasing head drive frequency, the ink discharging amount decreases when the head drive frequency is increased. When the ink discharging amount is decreased, the ink jet recording apparatus may produce an output image having a so-called white line problem which occurs, for example, due to a shortage in the amount of ink discharged. The ink jet head also has another characteristic such that the ink discharging amount relates to a viscosity of the ink and the ink discharging amount decreases when a viscosity of the ink is increased. Since viscosity of ink is increased when a temperature around the ink jet head is decreased, the ink discharging amount is decreased with decreasing temperature around the ink jet head. In this case, the ink jet recording apparatus may also produce the above-mentioned white line problem.

Japanese Laid-Open Patent Application No. 55-27210 discloses an ink jet recording apparatus which changes a voltage level of an ink jet head drive pulse according to environmental temperature.

Also, Japanese Laid-Open Patent Application No. 63-260452 discloses a liquid discharge type recording apparatus which varies a fall time of an ink jet head drive pulse according to an environmental temperature.

However, as the head drive frequency of the background ink jet recording apparatus increases, a reduction curve of ink discharging amount may become steeper to such an extent that compensating according to the environmental temperature is not sufficient.

In addition, the ink jet recording apparatus is often provided with a so-called draft print mode in which an output image is produced in a time faster than that in a regular print mode. In the draft print mode, high priority is given to print speed over print quality. In general, a carriage speed is increased but the head drive frequency is held the same in the draft print mode so that an output image can be produced in a relatively faster time. However, since a dot pitch between adjacent dots becomes greater, the output image is accordingly produced in an inferior print quality.

Therefore, there is presently no ink jet recording apparatus which is capable of increasing a print speed without causing an ink supply shortage to an output image.

SUMMARY OF THE INVENTION

Accordingly, an object of the present invention is to provide a novel ink jet recording apparatus capable of increasing a monochrome print speed without causing ink supply shortage to an image.

To achieve the above-mentioned object, a novel ink jet recording apparatus according to the present invention includes a carriage, a plurality of ink jet heads mounted on the carriage and including first, second, and successive ink jet heads respectively using first, second, and successive color inks for making dots in first, second, and successive colors respectively. The above-mentioned ink jet recording apparatus further includes a head drive circuit for selectively driving the plurality of ink jet heads at a first head drive frequency. A carriage drive circuit is provided for driving the carriage at a first carriage drive speed. A mode selecting circuit selects a multiple-head monochrome print mode in which a monochrome print operation is performed by alternatively driving the first ink jet head and at least one of the second and successive ink jet heads and an image is formed in such a way that a dot in the first color and at least one of dots in the second and successive colors are positioned in an alternating sequence. A control circuit is provided for controlling the head drive circuit to perform a monochrome print operation in the multiple-head monochrome mode and to adjust a head drive frequency from the first head drive frequency to a second head drive frequency which is equal to or lower than the first head drive frequency and for controlling the carriage drive circuit to adjust a carriage drive speed from the first carriage drive speed to a second carriage drive speed which exceeds the first carriage drive speed, when the multiple-head monochrome print mode is selected by the mode selecting circuit.

Other objects, features, and advantages of the present invention will become apparent from the following detailed description when read in conjunction with the accompanying drawings.

This application is based on Japanese Patent Application Nos. JAP08-301902 and JPAP08-314458 filed on Nov. 13, 1996 and Nov. 26, 1996, respectively. The entire contents of the Japanese Patent Applications are hereby incorporated by reference.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

FIG. 18 is a table showing exemplary combinations of a print pattern and a head drive voltage to be changed in accordance with variations of temperature;

FIG. 19–20 are data tables according to the table shown in FIG. 18;

FIG. 24 is a table showing exemplary combinations of a print pattern, a carriage speed, and a head drive frequency to be switched in accordance with a selection of print modes;

DESCRIPTION OF THE PREFERRED EMBODIMENTS

Figure 1:
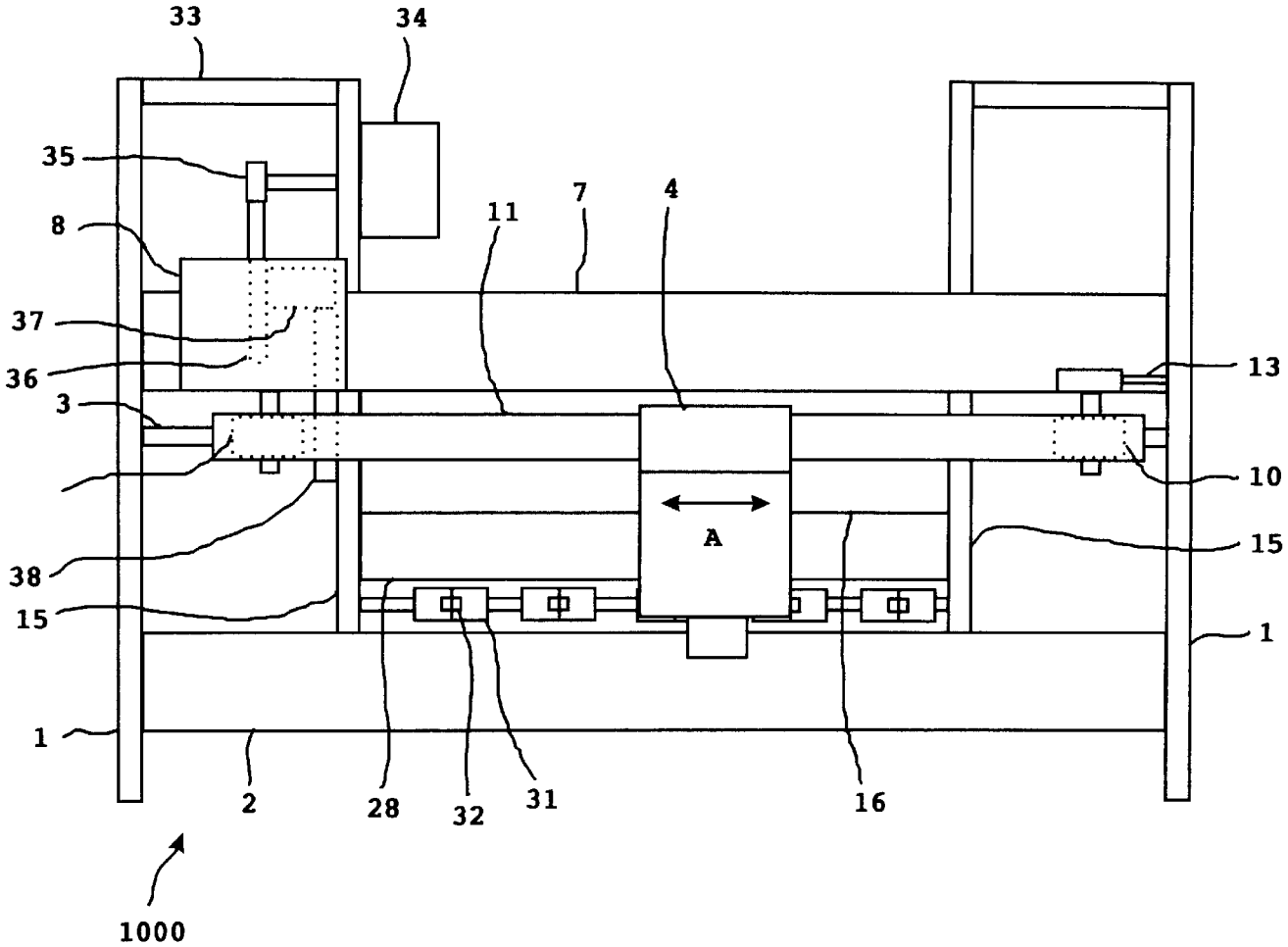
FIG. 1 is a top view of a novel ink jet recording apparatus according to an embodiment of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Figure 2:
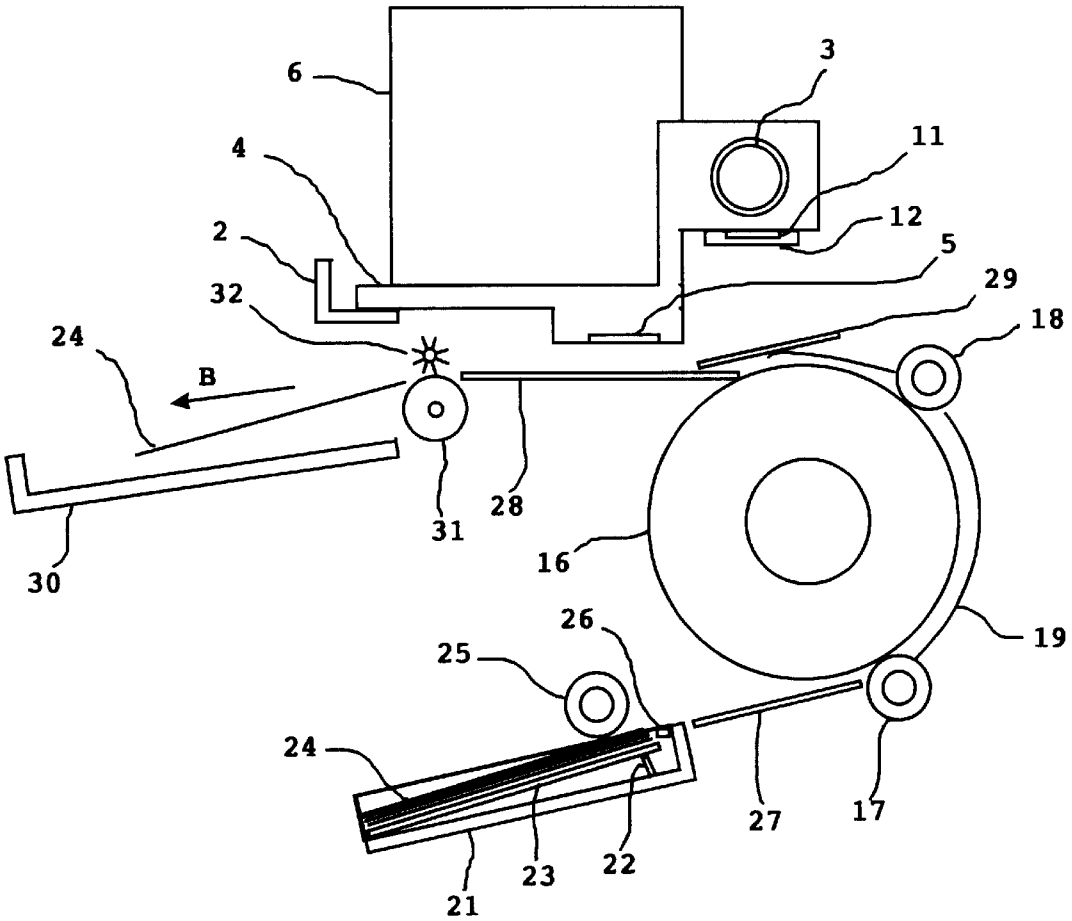
FIG. 2 is a side view of major portions of the ink jet recording apparatus shown in FIG. 1.

Reference will now be made to the drawings, wherein like reference numerals designate identical or corresponding parts throughout the several views, and more particularly to FIGS. 1 and 2 thereof. FIGS. 1 and 2 show a top view of a novel ink jet recording apparatus 1000 as an exemplary embodiment of the present invention and a side view of a main portion of the ink jet recording apparatus 1000.

As shown in FIG. 1, this ink jet recording apparatus 1000 includes a pair of main frames 1 provided at the left and right ends thereof. The pair of main frames 1 supports a front guide 2 and a guide shaft 3 for movably supporting a carriage 4. The carriage 4 is provided with a recording head 5 that includes a plurality of ink jet heads therein for discharging ink of yellow (Y), magenta (M), cyan (C), or black ($B_k$) colors, respectively. Installed on the carriage 4 is a replaceable ink cartridge 6 containing a plurality of ink tanks for various colors corresponding to each of the plurality of ink jet heads.

The pair of main frames 1 further supports an L-shaped bar 7 to which a main scanning motor 8 is fixed. On the rotating shaft of the scanning motor 8 and the L-shaped bar 7, motor pulley 9 and side pulley 10 are mounted, respectively. An endless belt 11 is trained, under tension, around the motor pulley 9 and the side pulley 10 and extends there-between.

The belt 11 is clamped to the carriage 4 by a belt clamp 12 as shown in FIG. 2, so that the carriage 4 can be moved in the main scanning direction (indicated by arrows A) by driving the main scanning motor 8. The side pulley 10 mounted on the L-shaped bar 7 has play in the main scanning direction so as to evenly adjust the tension of the endless belt 11 using a tension spring 13.

The ink jet recording apparatus 1000 in FIG. 1 further includes a pair of sub-scanning frames 15 for rotatably supporting a platen roller 16. Around the platen roller 16, feeding rollers 17 and 18 are disposed in such a way that they are pressed to the surface of the platen roller 16, as shown in FIG. 2. A paper-pan 19 for guiding a recording sheet 24 is also disposed around the platen roller 16 as shown in FIG. 2.

Further in FIG. 2, the ink jet recording apparatus 1000 includes a recording sheet cassette 21, in a front lower part thereof, including a spring 22 and an upward-moving tray 23 for pushing upward a bunch of recording sheets 24 by the tension of the spring 22. The recording sheet cassette 21 further includes a feed roller 25 for transferring the recording sheet 24 and a set of corner pawls 26 for separating a sheet from the plurality of recording sheets 24. The ink jet recording apparatus 1000 further includes a first sheet guide 27 for guiding the recording sheet 24 towards an opening formed between the platen roller 16 and the paper-pan 19, thereby forwarding the recording sheet 24 along the surface of the platen roller 16.

Further, in FIG. 2, the ink jet recording apparatus 1000 includes second and third sheet guides 28 and 29, disposed around the top portion of the platen roller 16 and underneath the carriage 4, for guiding the recording sheet 24 toward an area formed between an eject roller 31 and a sprocket wheel 32 so as to forward the recording sheet 24 to an eject tray 30.

The ink jet recording apparatus 1000 shown in FIG. 1 further includes a left side sub-scanning frame 33 and a sub-scanning motor 34 which is fixed on the left side sub-scanning frame 33. As shown in FIG. 1, a motor gear 35 is mounted on the rotating shaft of the sub-scanning motor 34 and an idler gear 36 is disposed to be meshed with the motor gear 35. The idler gear 36 has a connected idler gear 37 rotating therewith. The connected idler gear 37 is meshed with a platen gear 38 fixed on the end of the platen roller 16. Thereby, the rotational movement of the sub-scanning motor 34 is transferred to the platen roller 16 and the various associated rollers mentioned above, via the motor gear 35, the idler gear 36, the connected idler gear 37, and the platen gear 38. As a result, the recording sheet 24 can be transferred from the recording sheet cassette 21 to the eject tray 30 as indicated by arrow B shown in FIG. 2.

With the thus-arranged configuration, the ink jet recording apparatus 1000 performs an operation of producing a monochrome or a color output image on the recording sheet 24 by moving the carriage 4 in the main scanning direction and the recording sheet 24 in the sub-scanning direction while controlling the ink jet heads on the recording head 5 that discharges ink of desired colors from the respective nozzles thereof.

Figure 3:
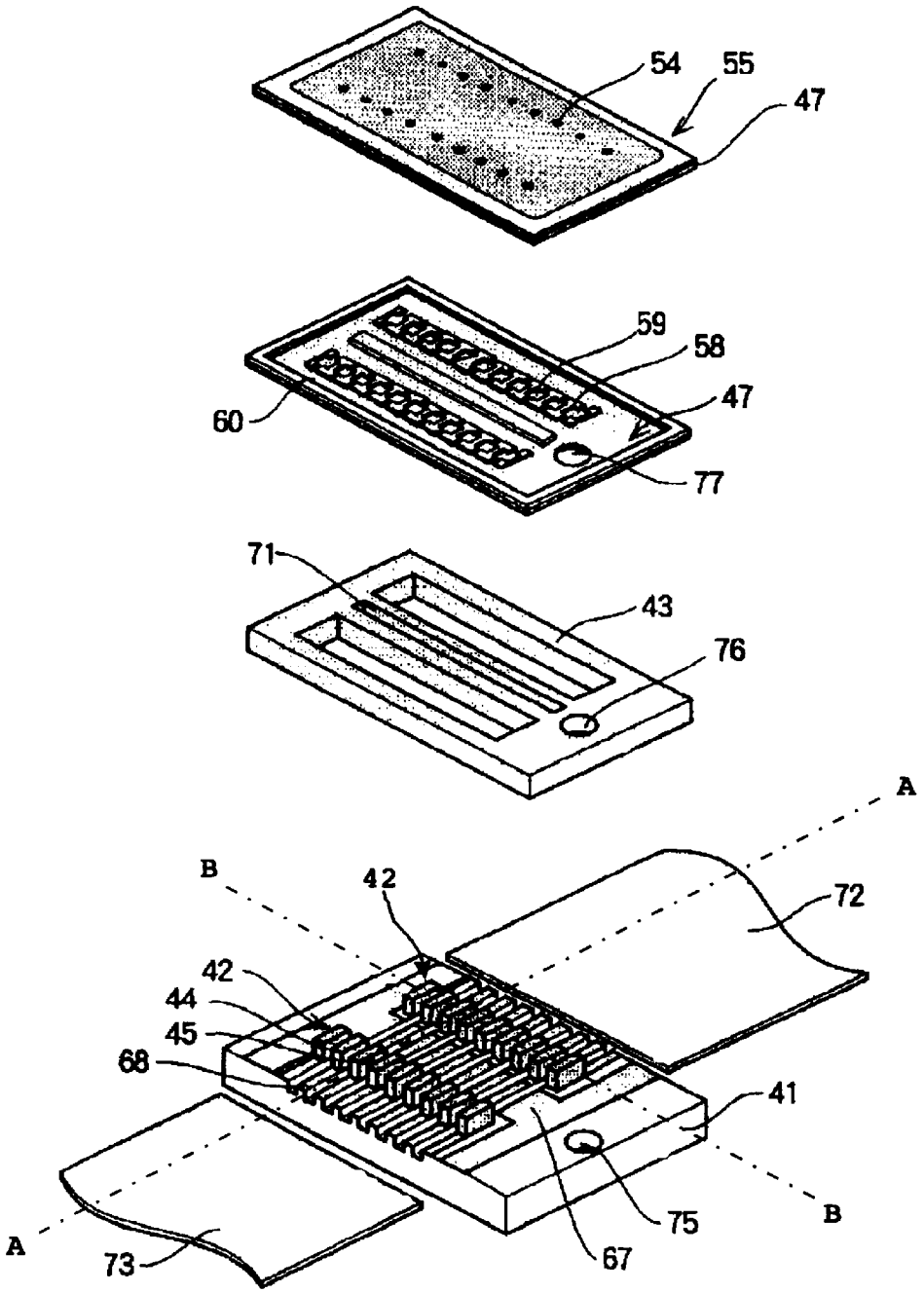
FIG. 3 is an exploded view of an exemplary ink jet head used in the ink jet recording apparatus of FIG. 1.
Figure 4:
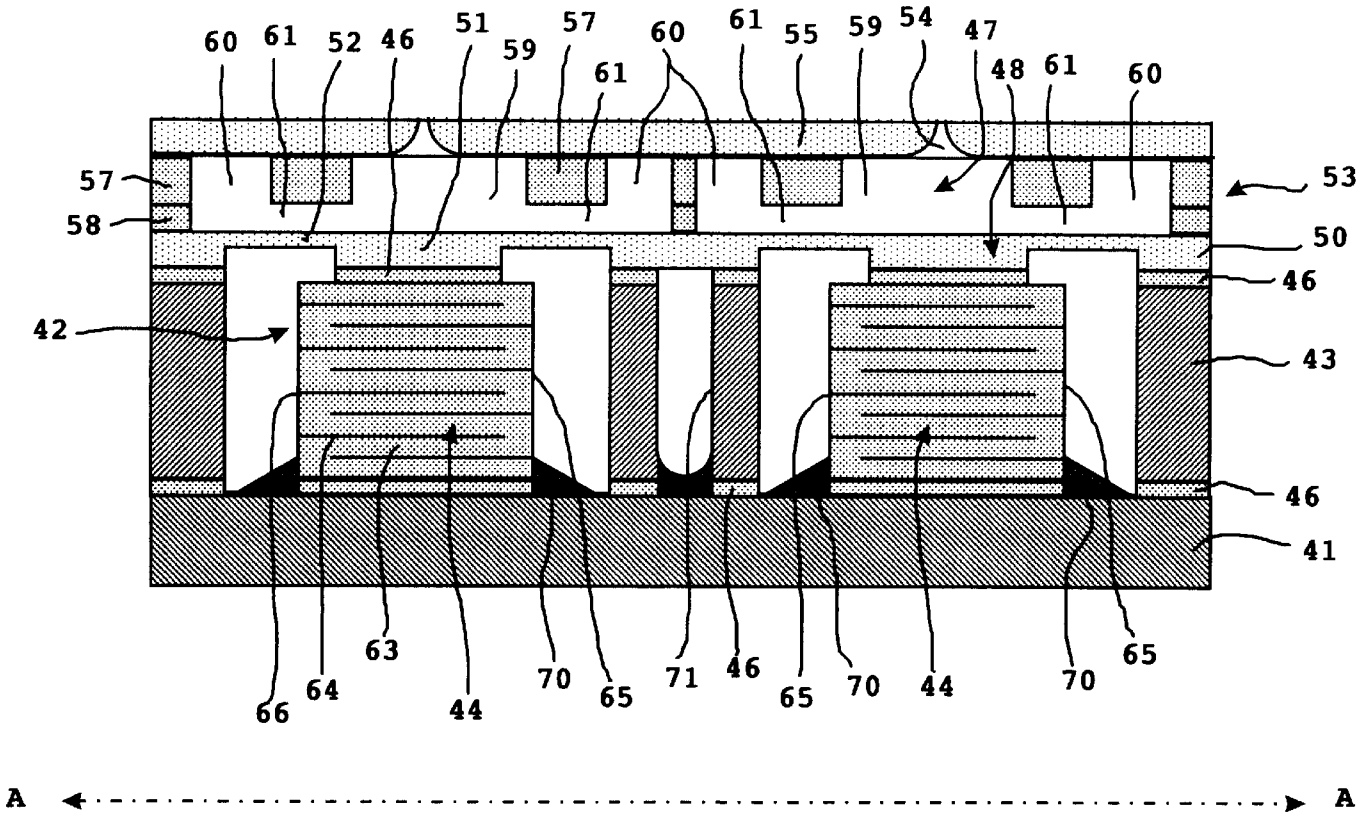
FIG. 4 is a cross-sectional view of the exemplary ink jet head shown in FIG. 3.
Figure 5:
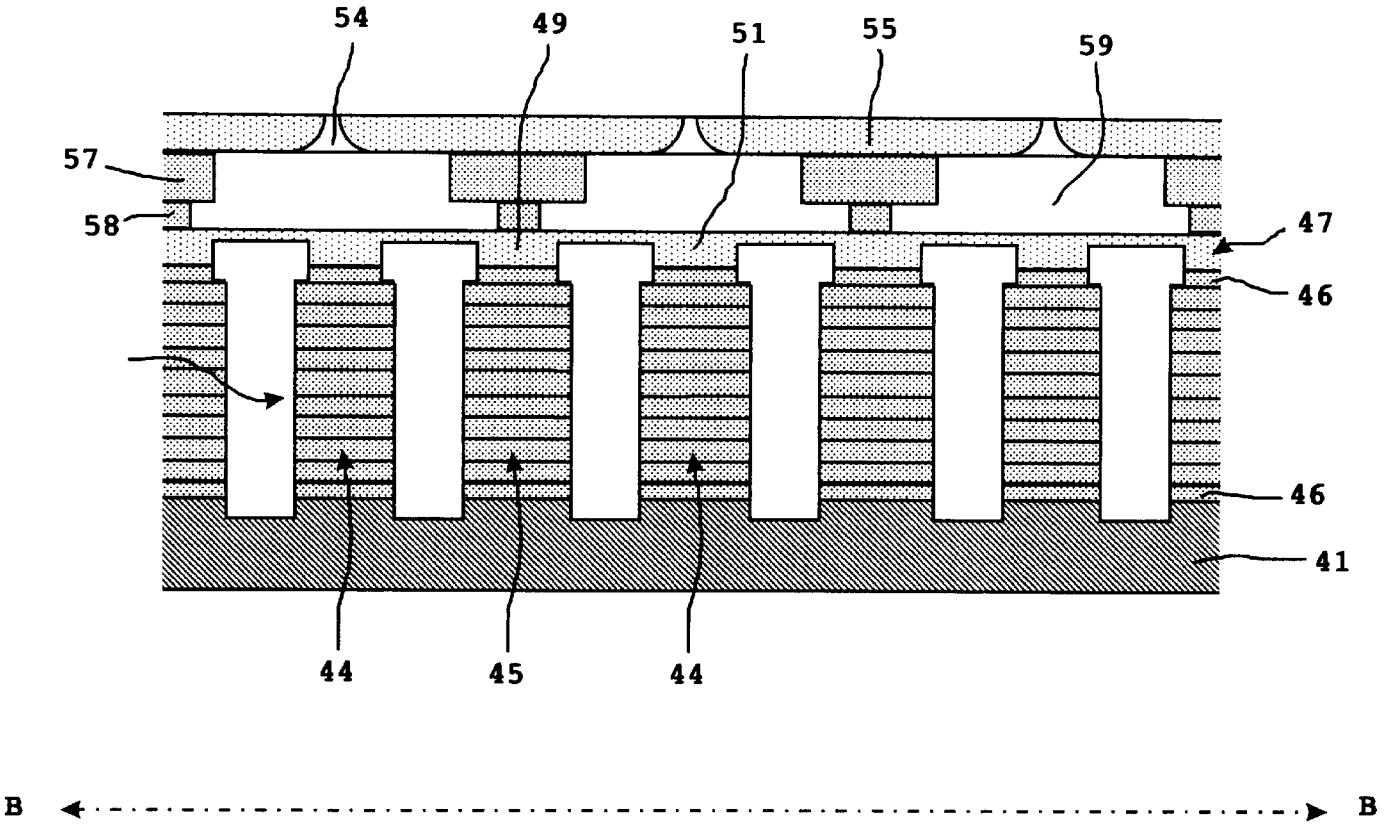
FIG. 5 is a portion of a cross-sectional view in a transverse direction relative to the cross-sectional view of the exemplary ink jet head shown in FIG. 4.

Next, an exemplary structure of the ink jet head of the recording head 5 is explained with reference to FIGS. 3–5. FIG. 3 shows an exploded perspective view of the ink jet head. FIGS. 4 and 5 show cross sectional views of the ink jet head taken along lines A—A and B—B in FIG. 3, respectively. As shown in FIG. 3, the ink jet head used in the recording head 5 includes a dielectric substrate 41 made of ceramic, glass epoxy resin, or the like, for example. On the substrate 41, a plurality of laminate type piezoelectric devices 42 arranged in two rows and a frame 43 for enclosing each one of the rows of piezoelectric devices 42 are mounted using a glue 46 (FIG. 5).

As shown in FIG. 5, the piezoelectric devices 42 include a driving portion 44 for serving as an actuator and a non-driving portion 45 for reinforcing the structure and are disposed in a staggered sequence. The top surfaces of the piezoelectric devices 42 and the frame 43 are arranged to be substantially in a plane by trimming the height. A vibrator 47 is mounted on the trimmed tops of the piezoelectric devices 42 and the frame 43 (FIG. 4) by the glue 46.

As shown in FIG. 4, the vibrator 47 is configured by a diaphragm 48 for vibrating, a joist 49 (FIG. 5) to be mounted on the non-driving portion 45, and a base 50 for mounting the frame 43. The diaphragm 48 includes a terrace-like portion 51 disposed above the driving portion 44 and a pair of thin-film-like portions 52.

A partition member 53, made from a photosensitive resin film and having an upper partition 57 and a lower partition 58, for partitioning each ink chamber is glued onto the vibrator 47. A nozzle plate 55 including a plurality of nozzles 54 arranged in two rows is glued onto the partition member 53.

As shown in FIG. 4, the partition member 53, the vibrator 47, and the nozzle plate 55 form a plurality of pressure ink chambers 59 disposed above the driving portion 44, a plurality of common ink chambers 60, disposed around both sides of the pressure ink chamber 59, and a plurality of ink supply passages 61 each for connecting the pressure ink chambers 59 and the common ink chambers 60 and also each for serving as a portion of resistance to the ink flow.

The laminate type piezoelectric device 42 shown in FIG. 4 consists of, in an alternate sequence, a PZT layer 63, made of $Pb(ZrTi)O_3$ and having a 10- to 50- $\mu$m range thickness, and an inner electrode 64 made of AgPd and having a thickness in the range of several micrometers.

The thus-arranged multiple-layer structure makes it possible to drive the piezoelectric device 42 by a relatively low voltage. For example, the piezoelectric device 42 can be driven by a pulse in the 10- to 50-volt range to produce a relatively strong electric field of above 1000 volts. The piezoelectric device 42 may also be formed of other common piezoelectric device materials such as $BaTiO_3$, $PbTiO_3$, $(Nak)NbO_3$, and so forth.

The inner electrodes 64 of the piezoelectric device 42 are connected to outer electrodes 65 and 66 made of AgPd in an alternate sequence by each layer, as shown in FIG. 4. A conductive pattern is formed on the substrate 44 between the two rows of piezoelectric devices 42 for functioning as a common electrode 67 for applying a driving signal to the driving portion 44. Another conductive pattern is formed on the substrate 44 for functioning as individual electrodes 68 for providing selection signals to the driving portion 44. As shown in FIGS. 3 and 4, the outer electrode 65 of the driving portion 44 is connected to the common electrode 67 via an electrically conductive adhesive agent 70, which can be a silver paste, for example, and the outer electrode 66 of the driving portion 44 is connected to an individual electrode 68 via the electrically conductive adhesive agent 70.

Connections made between the driving portions 44 and the common electrodes 67 are reinforced by applying a coating of the electrically conductive adhesive agent 70 inside an opening 71 formed in the middle part of the frame 43, as shown in FIG. 4.

The common electrode 67 and the individual electrode 68 are connected with FPCs (flat printed cables) 72 and 73, respectively, as shown in FIG. 3.

The substrate 41, the frame 43, and the vibrator 47 are commonly formed with ink supply holes 75, 76, 77, respectively, for supplying ink supplied from an ink cartridge 6 (FIG. 2) to the common ink chambers 60.

In the thus-configured ink jet head, an ink discharging operation is performed in the following manner. During an ink discharging process in the ink discharging operation, a driving signal in the 10- to 50-volt range in accordance with a recording signal is applied to the driving portion 44 of the ink jet head and the driving portion 44 is displaced in the transverse direction relative to the direction of the multiple layers. Accordingly, the displacement of the driving portion 44 becomes pressure to be applied to the ink in the ink chamber 59 via the diaphragm 48 of the vibrator 47 and the pressure inside the ink chamber 59 rises. Then, ink is discharged through the nozzle 54 of the ink jet head and the ink discharging process is ended.

When the pressure inside the ink chamber 59 rises during the above-mentioned ink discharging process, the ink in the ink chamber 59 also flows toward the common ink chambers 60 via the ink supply passages 61. However, the cross-sectional area of the ink supply passages 61 is formed to be relatively small so as to function as an ink flow resistance. That is, the ink supply passages 61 decrease the amount of ink flow to the common ink chambers 60 and, as a result, prevent reduction in the ink discharging efficiency.

By discharging the ink during the ink discharging process, the pressure inside the pressure ink chamber 59 decreases and the process proceeds to an ink supply process. When the pressure inside the pressure ink chamber 59 decreases by discharging the ink, negative pressure is generated inside the pressure ink chamber 59 by the remaining flow of the ink towards the common ink chamber 60 and the process in which the driving portion 44 is retracted in accordance with the end of the driving pulse. The common ink chambers 60 are then supplied with ink from the ink cartridge 6 (FIG. 2) and the ink flows into the pressure ink chamber 59 via the ink supply passages 61. The vibration of ink around the nozzle 54 in the pressure ink chamber 59 decays its vibration. Then, the ink surface around the nozzle 54 eventually stabilizes by surface tension. In this way, the ink supply process is ended and the process proceeds to the next ink discharging process.

Next, a head drive unit 100 included in the ink jet recording apparatus 1000 is explained with reference to FIGS. 6–9. Hereinafter, the ink jet head included in the recording head (FIG. 2) is referred to as H, on a needed basis of the sake of convenience. Also, the piezoelectric device 42 used as an ink discharging device is referred to as PZT, the common electrode 67 as COM, and the individual electrode 68 as SEL. The ink jet recording apparatus 1000 includes four ink jet heads for discharging yellow, (Y), magenta (M), cyan (C), and black ($B_k$) ink, respectively, and are referred to as Y, M, C, and $B_k$ heads, respectively.

Figure 6:
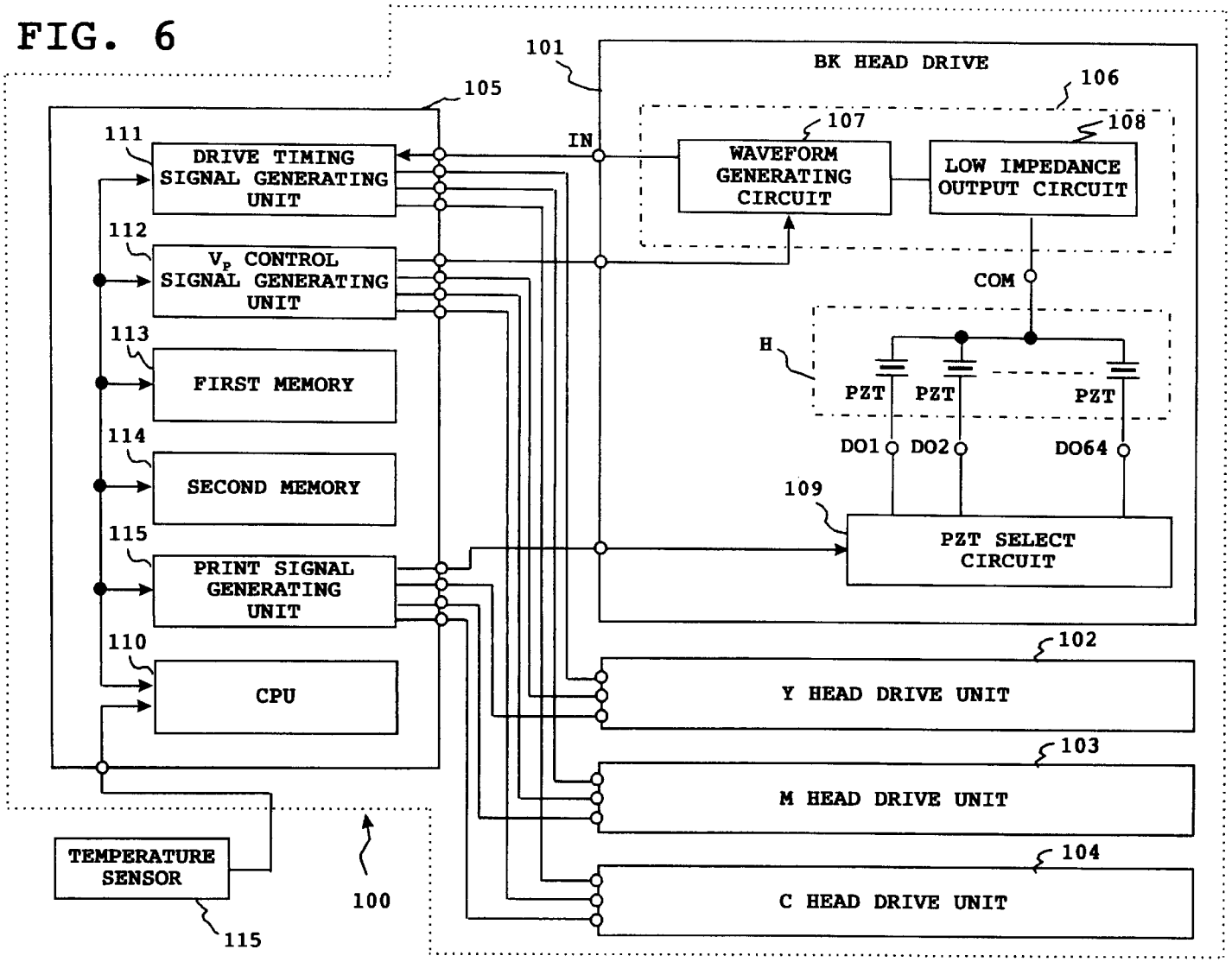
FIG. 6 is a block diagram of an exemplary head drive unit of the ink jet recording apparatus shown in FIG. 1.

FIG. 6 shows a block diagram of the head drive unit 100 on the ink jet recording apparatus 1000. Since the four driving heads have the same structure, only the $B_k$ head is illustrated in detail as an example in FIG. 6. Each one of the ink jet heads (Hs) included in the recording head 5 (FIG. 2) includes 64 nozzles, for example, and 64 corresponding piezoelectric devices. Every piezoelectric device (PZTs) has the common electrode (COM) which is commonly connected to all the PZTs and a select electrode (SEL) to be used for selection of the PZT.

The head drive unit 100 shown in FIG. 6 includes the $B_k$, Y, M, and C head drive units 101–104 and a control unit 105 for applying control signals and so forth to the above-mentioned head drive units 101–104. The control unit 105 may be configured by using a CPU (central processing unit) 110 for controlling the entire operation of the system and the like.

The $B_k$ head drive unit 101 includes a constant voltage drive circuit 106 and a PZT select circuit 109. The voltage drive circuit 106 of the $B_k$ head drive unit 101 includes a waveform generating circuit 107 for receiving a head drive timing signal, referred to as a STB (strobe), sent from the control unit 105 and for generating and outputting a signal having a head drive waveform. The constant voltage drive circuit 106 further includes a low impedance output circuit 108 for changing the signal from the waveform generating circuit 107 to a relatively low impedance signal and for outputting the relatively low impedance signal to the common electrode (COM) of the ink jet head (H). The PZT select circuit 109 generates PZT select signals $D_{01}$–$D_{64}$ for designating specific PZTs of the ink jet head (H) in accordance with a print data signal DI (data in) sent from the control unit 105.

The waveform generating circuit 107 of the constant voltage drive circuit 106 may be composed of a ROM (read only memory), a D/A (digital-to-analog) converter or a pulse generating circuit and a differential-and-integral circuit, and a waveform shaping circuit such as a clip circuit, a clamp circuit, and so on. The waveform generating circuit 107 receives, from a drive timing signal generating unit 111 of the control unit 105, the head drive timing signal (STB) for determining a timing for generating and outputting a head drive signal. The waveform generating circuit 107 further receives signals $Sv_p$1–$Sv_p$3, outputted from a $V_p$ control signal generating unit 112 for determining a voltage of the drive signal and signals STR1–STR3 for selecting a time constant TC for determining a rise time of the drive signal which will be later explained.

The low impedance output circuit 108 included in the constant voltage drive circuit 106 includes a relatively low impedance amplifying circuit that may be composed of a buffer amplifying circuit, a SEPP (single ended push-pull) circuit, and so forth. With the low impedance output circuit 108, the head drive signal outputted from the waveform generating circuit 107 can be changed to a low impedance signal for the PZTs and, as a result, the head drive signal will not be deformed due to variations amongst the PZTs and/or the number of PZTs to be driven.

In addition to the above-mentioned drive timing signal generating unit 111 and the $V_p$ control signal generating unit 112, the control unit 105 further includes a first memory 113 for storing relationships between environmental temperature and source voltages for generating the head drive voltage $V_p$ (later explained), a print signal generating unit 115 for generating and outputting the print data signal DI, and a second memory 114 for storing data representing relationships between dot patterns and environmental temperature (later explained). Also, the control unit 105 receives a detection signal sent from a temperature sensor 116 for detecting an environmental temperature around the ink jet heads.

Figure 7:
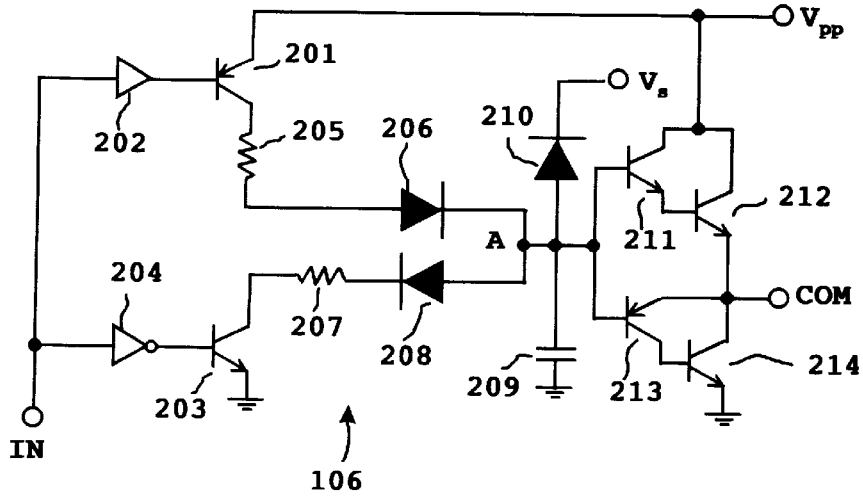
FIG. 7 is an exemplary circuit diagram of a constant voltage generating circuit used in the head drive unit.

FIG. 7 shows an example of the constant voltage generating circuit 106. The constant voltage generating circuit 106 has an input terminal IN to which the head drive timing signal (STB) is applied. The input terminal IN is connected, via a buffer circuit 202, to a base of a transistor 201 pulled up to a source power voltage $V_{pp}$, and also, via an inverter circuit 204, to a bass of a transistor 203 connected to a ground of the circuit.

To a collector of the transistor 201, a resistor 205 and a diode 206 are connected in series. Also, to a collector of the transistor 203, a resistor 207 and a diode 208 are connected in series. A cathode side of the diode 206 is connected to an anode side of the diode 208 and the thus-made junction is referred to as junction A at which a head drive voltage $V_p$ is produced. A capacitor 209 is placed between the junction A and the ground of the circuit, so that the capacitor 209 and the resistor 205 form an RC (resistance-capacitance) circuit for providing a time constant operable during an electric charging time period and the capacitor 209 and the resistor 207 form an RC (resistance-capacitance) circuit for providing a time constant operable during an electric discharging time period. The junction A is applied with a head drive source voltage $V_s$ via a diode 210.

Transistors 211–214 of FIG. 7 form an example of the low impedance output circuit 108 of the constant voltage generating circuit 106. The above-mentioned junction A is connected to bases of the transistors 211 and 213. An emitter of the transistor 212 and a collector of the transistor 214 are connected to each other to make a junction at which an output signal is generated. The thus-made junction is connected to the common electrode COM of the ink jet head H.

In the constant voltage generating circuit 106 configured in the above-mentioned manner, when the head drive timing signal STB which is an active high signal is applied to the input terminal IN, the buffer circuit 202 generates an output signal of which voltage is arranged to be lower than the source power voltage $V_{pp}$. The transistor 201 is then switched to an on-state by receiving the above-mentioned output signal from the buffer circuit 202. At the same time, the inverter circuit 24 generates a low signal and, then, by receiving the low signal from the inverter circuit 204 the transistor 203 is switched to an off-state.

Then, the RC circuit formed by the resistor 205 and the capacitor 209 starts a charging operation in which the capacitor 209 is charged for a period of a time constant determined by the values of the resistor 205 and the capacitor 209. Since the junction A is pulled up to $V_s$ via the diode 210 that forms a clip circuit, a charge level of the capacitor 209 is clipped at a clip level determined by the clip circuit before reaching the source power level $V_{pp}$ during the charging operation. In this case, a clip level is a sum of $V_s$ and a voltage drop $V_d$ by the diode 210. The head drive voltage $V_p$ at the junction A is thus risen and clipped at the above-mentioned clip level. Accordingly, a maximum voltage of the head drive voltage $V_p$ is the sum of $V_s$ and $V_d$.

When an application of the head drive timing signal STB to the input terminal IN is ended and the buffer circuit 202 accordingly receives a low signal, an output of the buffer circuit 202 is pulled up to the level of the source power voltage $V_{pp}$. The transistor 201 is then switched to an off-state with such an output voltage at the buffer circuit 202. At the same time, the inverter circuit 204 is switched to generate a high signal and, then, by receiving the high signal from the inverter circuit 204 the transistor 204 is switched to an on-state.

Then, the RC circuit formed by the resistor 207 and the capacitor 209 starts a discharging operation in which the charge of the capacitor 209 which is accumulated up to the value $V_p$ is discharged for a period of a time constant determined by the values of the resistor 207 and the capacitor 209.

In this way, the head drive voltage $V_p$ is generated in accordance with the input of the head drive timing signal STB.

Since the maximum value of the head drive voltage $V_p$ is the sum of $V_s$ and $V_d$, such a head drive voltage $V_p$ can be varied by changing $V_s$ to vary the voltage $V_p$.

Figure 8:
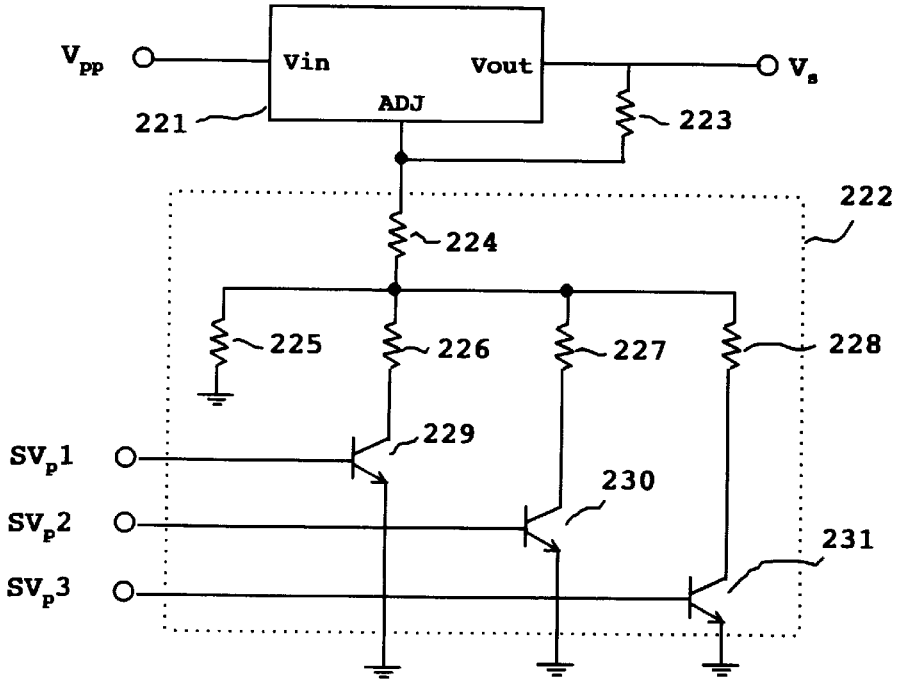
FIG. 8 is an exemplary circuit diagram for generating a variable power source to be inputted to the constant voltage generating circuit.

The circuit for controlling $V_s$ shown in FIG. 8 includes a voltage regulator 221 and a resistor select circuit 222.

The voltage regulator 221 has an input terminal $V_{in}$ for receiving the source power $V_{pp}$, an output terminal $V_{out}$ for outputting $V_s$, and an adjust signal terminal ADJ, and may by an LM317T manufactured by National Semiconductor Corporation, for example. The voltage regulator 221 generates $V_s$ from the output terminal $V_{out}$ in accordance with a resistance value of the resistor select circuit 222 placed between the ADJ terminal and the ground of the circuit and a resistor 223 placed between the ADJ and the $V_{out}$ terminals, as shown in FIG. 8. In the case of using an LM317T as mentioned above, a voltage to be generated across the resistor 223 is approximately 1.25 volts and a value of $V_s$ is determined by an equation $V_s=1.25\times(1+R_2/R_1)$ according to the specification of the LM317T.

The resistor select circuit 222 includes resistors 224–228 and transistors 229–231 and may be an SN7406 manufactured by Texas Instruments, for example. One side of the resistor 225 is connected to the ground of the circuit and the other side is connected to one side of the resistors 224 and 226–228. The other side of the resistor 224 is connected to the ADJ terminal of the voltage regulator 221. The other sides of the resistors 226–228 are connected to the collectors of transistors 229–231, respectively. The bases of transistors 229–231 are driven with select signals SV1–$SV_p$3, respectively, for selecting at least one of the transistors 229–231. To select at least one of the resistors 226–228, $V_p$ control signals $SV_p$1–$SV_p$3 are sent from $V_p$ control signal generating unit 112 of the control unit 105 and applied to the bases of the transistors 229–231, respectively.

With the thus-arranged circuit, the head drive source voltage $V_s$ can be varied up to a maximum of eight levels of voltage by changing conditions of the signals $SV_p$1–$SV_p$3 which are used as three-bit inputs. By controlling $V_s$ in this way, the head drive voltage $V_p$ can be set to a desired voltage level.

Alternatively, the head drive voltage $V_p$ can be varied by using, for example, a circuit that includes in series a resistor and a parallel circuit of a variable resistor and a capacitor. In this case, a voltage across the capacitor is set to $V_p$ that can be varied by varying a value of the variable resistor.

Figure 9:
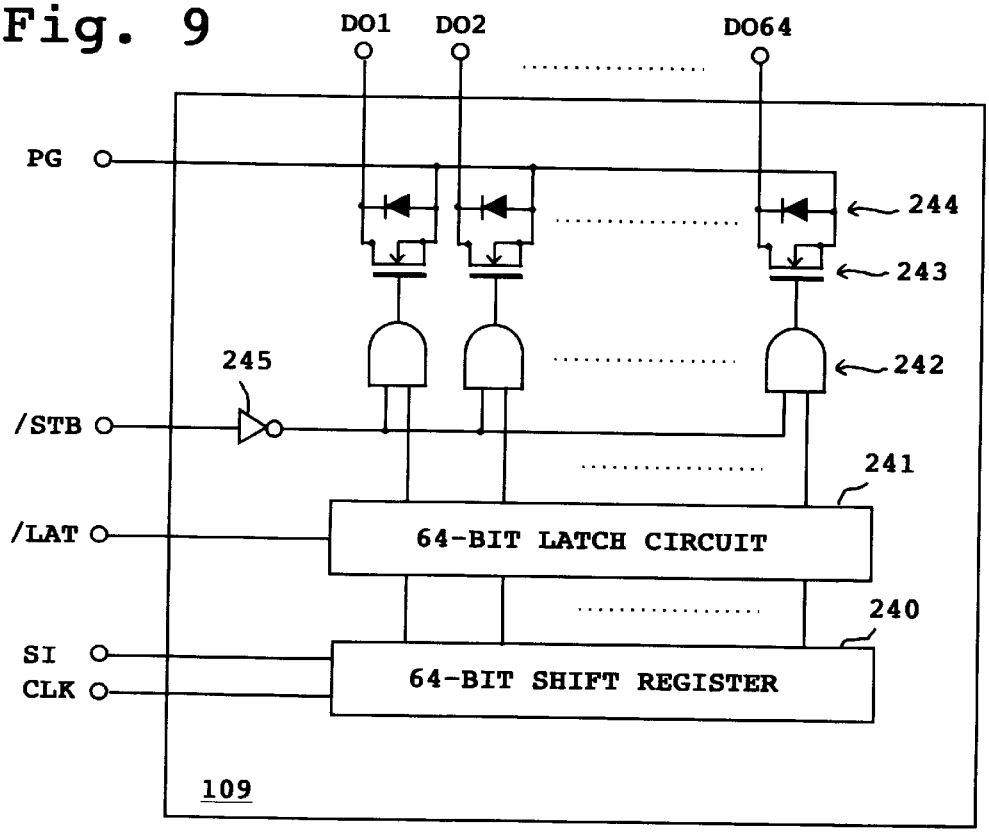
FIG. 9 is an exemplary circuit of a head select circuit.

FIG. 9 shows an example of the PZT select circuit 109. The PZT select circuit 109 includes a 64-bit shift register 240, a 64-bit latch circuit 241, a gate circuit 242, a transistor array 243, and a diode array 244. To control the plurality of the PZTs, the shift register 240 includes at least the same plurality of bits. Since in this embodiment each ink jet head H includes 64 PZTs for the 64 nozzles, a 64-bit shift register 240 for converting input data into serial 64-bit data is used.

The 64-bit latch circuit 241 latches output signals from the 64-bit shift register 240 at a timing of an inverted latch signal /LAT (hereinafter, a slash symbol / before a signal name indicates that the signal is an inverted signal). The gate circuit 242 includes 64 gates for gating the output signals from the 64-bit latch circuit 241. An inverted timing signal /STB, via an inverter 245, is used as a timing signal by the gate circuit 242. The transistor array 243 includes 64 transistors each to be switched on and off individually by an output signal from the gate circuits 242. The diode array 244 includes 64 diodes each of which is coupled to a corresponding transistor among the 64 transistors included in the transistor array 243 and outputs a signal to a corresponding PZT among the 64 PZTs included in the ink jet head H. Anode sides of the 64 diodes of the diode array 244 are commonly connected to a power ground which is referred to as PG in FIG. 9.

The print data signal DI sent from the print signal generating unit 115 is referred to as serial data SI when entering the 64-bit shift resister 240 which serially shifts the serial data SI using a timing signal CLK. The 64-bit shift register 240 also outputs serial data SO to an outside of the PZT select circuit 109 via an output terminal (not shown). Then, the 64-bit shift register 240 outputs the SI data in 64 bits in parallel to the 64-bit latch circuit 241 which latches the SI data in 64-bits by a timing of the /LAT signal. The latched 64-bits of SI data are gated by the gate circuit 242 using a timing of the STB signal. By enabling gates of the gate circuit 242, the 64 bits of SI data switch the state of transistors of the transistor array 243 to an on-state, so that select signals among signals $D_{01}$–$D_{064}$ can be outputted in accordance with the 64 bits of SI data.

In this way, any desired PZT can be selected from among the 64 PZTs. The thus-selected PZTs can be driven by the ink jet head drive signal outputted from the low impedance output circuit 108.

Figure 10:
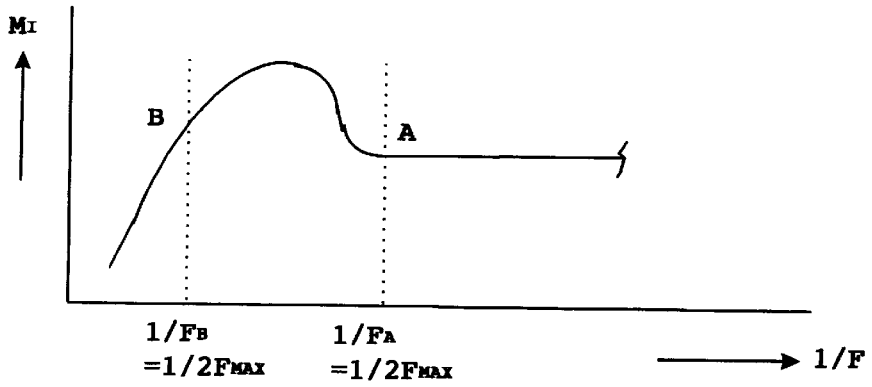
FIG. 10 is a graph for explaining a relationship between an amount of ink discharge and a head drive frequency.

Next, an operation of the head drive unit 100 is explained with reference to FIGS. 10–18. FIG. 10 shows a general relationship of variations between a frequency F of the head drive signal and an ink discharging amount M, of the ink jet head H. In FIG. 10, an inverse of the frequency F of the head drive signal is applied to the x-axis. In general, the ink discharging amount $M_i$ is preferred to be stabilized and constant even when the frequency F is varied. As shown in FIG. 10, the ink discharging amount $M_i$ is stabilized and substantially constant approximately in the 1/F range in which 1/F is greater than $1/F_A$ at a point A. That is, the frequency F of the head drive signal can be changed up to $F_A$ with the ink discharging amount $M_i$ kept stabilized and constant. This $F_A$ is referred to as a maximum value of the frequency of the head drive signal and is referred to as $F_{max}$ hereinafter. Also, a variation of the ink amount $M_i$, when the frequency F is increased to a high frequency $F_B$ which is twice the frequency $F_{max}$, is indicated by a point B in FIG. 10. A dotted line in FIG. 10 shows an event when the ink discharging amount $M_i$ is dramatically decreased by variations in additional factors such as an environmental temperature, which is explained later.

In this case, when the ink jet head H forms an image by ink dots with the carriage 4 driven at a carriage speed $V_c$, a dot pitch $D_p$ can be represented by $(V_c \times 1/F_{max})$ That is, when a minimum dot pitch corresponding to an image resolution is $D_p$ the maximum head drive frequency of the ink jet head H is $F_{max}$, and the carriage speed, at which the ink jet head H can be driven at the $F_{max}$ and an image can be made with the dot pitch $D_p$, is $V_c$, a relationship $D_p = V_c \times 1/F_{max}$ is established.

According to the above-mentioned relationship, it is necessary that the head drive frequency F be changed to a greater value than the maximum value $F_{max}$ when the carriage speed is increased to a value greater than $V_c$ to maintain the dot pitch $D_p$ at the same value. However, when the head drive frequency exceeds $F_{max}$, the ink discharging amount $M_i$ starts to vary. As a result, a size of an ink dot varies in accordance with the varying $M_i$, which typically occurs when the ink jet head is driven at a one hundred percent duty cycle in which ink is discharged every cycle of the head drive signal.

Figure 11:
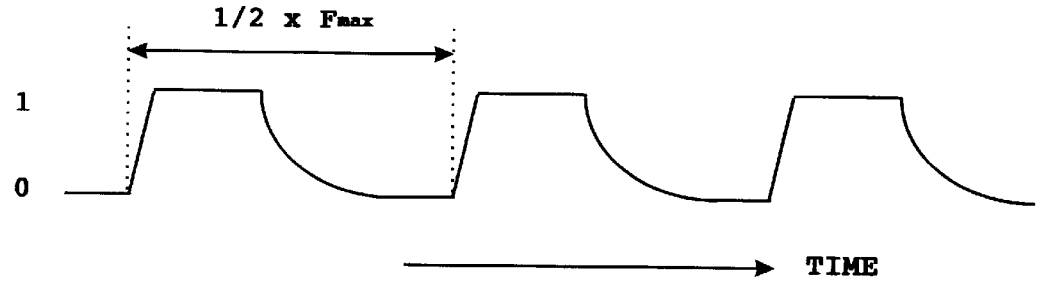
FIG. 11 is an example of a head drive pulse generated by the constant voltage generating circuit shown in FIG. 7.

When the main scanning speed of the carriage 4 is twice as fast as $V_c$, for example, the ink jet head H is needed to be driven at twice the frequency of $F_{max}$ to maintain substantially the same dot pitch $D_p$. In this case, the cycle of the head drive signal is $1/(2 \times F_{max})$ as illustrated in FIG. 11 in which the head drive signal of $1/(2 \times F_{max})$ is shown as an example.

Figure 12A:
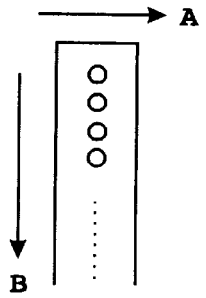
FIGS. 12(*a*)–13(*b*) are illustrations for explaining ways of positioning dots in a case of using only a black ink.
Figure 12B:
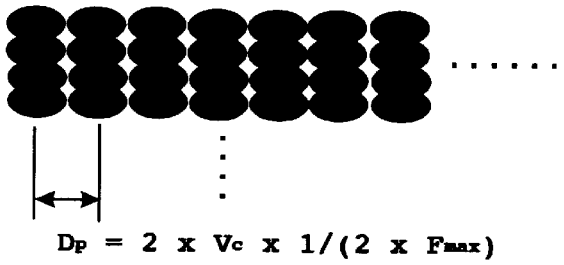

FIG. 12(*a*) shows a part of the $B_k$ head, for example, which is driven in both main scanning and sub-scanning directions (indicated by letters A and B, respectively). In this case, when the $B_k$ head is driven at a speed of $(2 \times V_c)$ and at a one hundred percent duty cycle, a frequency is twice as fast as $F_{max}$. FIG. 12(*b*) illustrates an output image formed by dots of which pitch is represented by $(2 \times V_c \times 1/(2 \times F_{max}))$. In this case, a so-called white line resulting in improper printing typically occurs due to insufficient ink discharging amount caused by such a high frequency as $(2 \times F_{max})$.

Figure 13A:
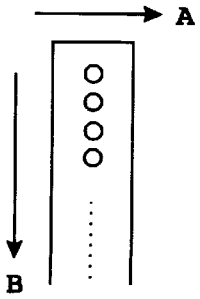
Figure 13B:
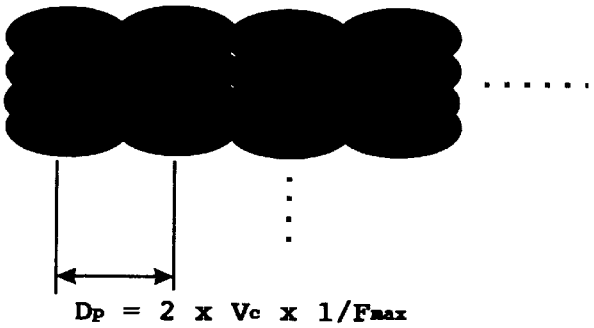

FIG. 13(*a*) shows another manner in which the $B_k$ head, for example, is driven in both main scanning and sub-scanning directions (indicated by letters A and B, respectively). In this case, when the $B_k$ head is driven at twice the speed of $V_c$ and at a fifty percent duty cycle instead of a hundred percent duty cycle, the substantial frequency of the head drive signal is $F_{max}$ and the dot pitch $D_p$ is substantially close to a value represented by $(2 \times V_c \times 1/F_{max})$ Since the frequency of the head drive signal is $F_{max}$, the ink discharging amount $M_i$ can be kept stabilized at a constant level. Accordingly, the white line problem will not occur. In this case, dots that form an image are formed in a manner as illustrated in FIG. 13(*b*).

The above-described reduction of the ink discharging amount $M_i$ directly relates to an ink discharging mechanism within the ink jet head H as discussed earlier. More specifically, if for some reason the ink jet head H starts an ink discharging process before the ink surface near the nozzle inside the ink chamber returns to a stable and ready condition, an ink discharging motion will be influenced and, as a result, the ink discharging amount $M_i$ varies. In particular, when the viscosity of ink is increased, the fluid resistance of ink may increase and performance of the ink supply to the pressure ink chambers where the ink discharging nozzles are provided may be degraded. As a result, the ink discharging amount $M_i$ may greatly be reduced.

Figure 14:
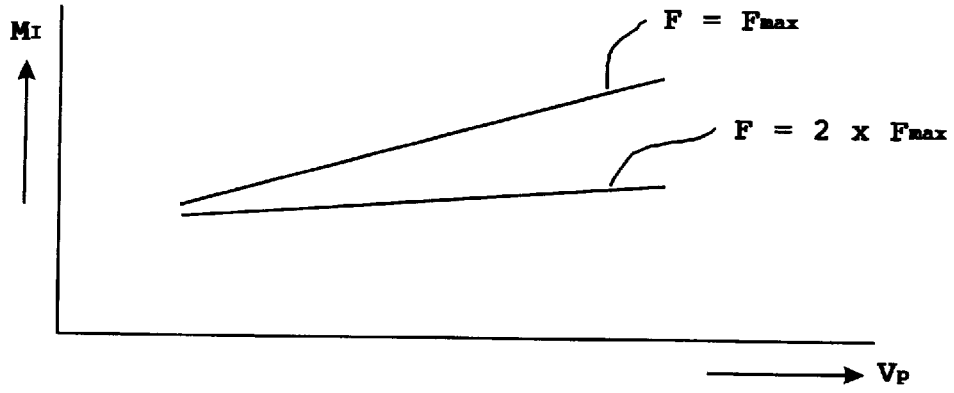
FIG. 14 is a graph for explaining relationships among the ink discharging amount, the head drive voltage, and the head drive frequency.

A possible way for compensating for the above-described reduction of the ink discharging amount $M_i$, especially during the ink discharging operation at a relatively high head drive frequency, is to increase the head drive voltage $V_p$. As shown in FIG. 14, an increase of the head drive voltage $V_p$ accordingly increases $M_i$ when the head drive frequency F is $F_{max}$. However, when the head drive frequency F is $(2 \times F_{max})$, $M_i$ may not be increased sufficiently even by increasing the head drive voltage $V_p$.

Another possible way is to increase performance of the ink supply to the pressure ink chambers in the ink jet head. This can be achieved by decreasing the fluid resistance of ink itself by decreasing the viscosity of ink or of the ink chamber by changing the structure thereof. However, decreasing the viscosity of ink may cause an inferior image quality and changing the structure of the ink chamber may cause a problem in which the size of the ink jet head becomes relatively large.

The head drive unit 100 of the ink jet recording apparatus 1000 is capable of compensating for the above-described reduction of the ink discharging amount $M_i$, especially during the ink discharging operation at a relatively high head drive frequency. More specifically, when the above-described relationship of $D_p = V_c \times 1/F_{max}$ is fulfilled, the head drive unit 100 starts to activate two or more ink jet heads in addition to the currently activated ink jet head. In this operation, the additionally activated two or more ink jet heads are controlled to discharge the respective ink so as to produce a mixed-color dot. Further, in this operation, each one of the additionally activated ink jet heads and the currently activated ink jet head are controlled to discharge ink in an alternate order.

Accordingly, both the additionally activated ink jet heads and the currently activated ink jet head are caused to produce dots at approximately a half of $D_p$.

By performing the above-described operation when the relationship of $D_p = V_c \times 1/F_{max}$ is fulfilled, the substantial head drive frequency is decreased to approximately a half of $D_p$. Therefore, the carriage speed can be increased to approximately twice the value of $V_c$ without causing reduction of ink discharging amount $M_i$. Alternatively, when the ink discharging amount $M_i$ is decreased for some reason, the carriage speed can be maintained at $V_c$ so as to compensate for the reduction of $M_i$.

Figure 15A:
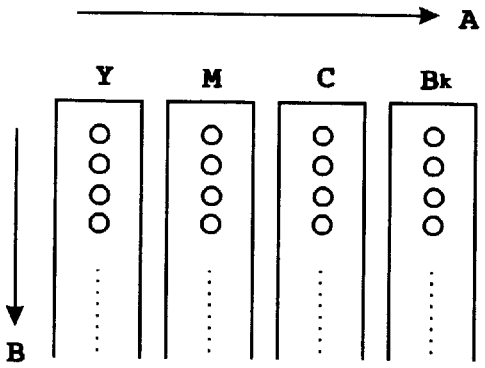
FIGS. 15(*a*)–17 are illustrations for explaining ways of positioning dots in a case of using a plurality of inks in different colors.
Figure 15B:
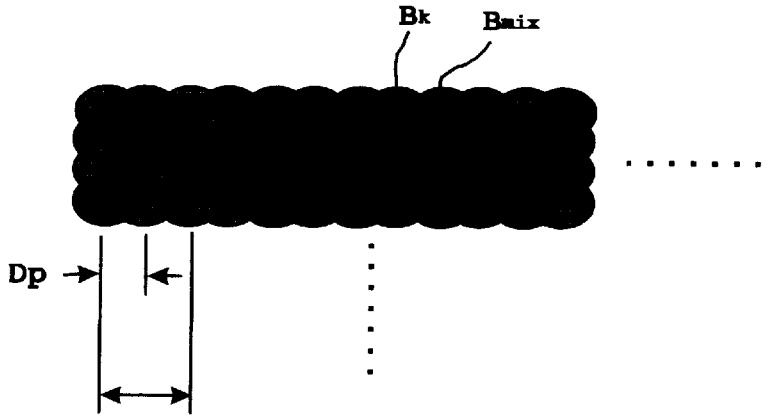

During this operation, the carriage 4 having the Y, M, C, and $B_k$ heads is driven at twice the speed of $V_c$ as shown in FIG. 15(*a*). Each head shown in FIG. 15(*a*) includes a plurality of nozzles disposed vertically in a row. When the $B_k$ head discharges ink, a discharged dot is referred to as a $B_k$ dot. In the same manner, other cases are referred to as Y, M, and C dots, respectively. In addition, a dot made by mixing the Y, M, and C colors also has a black color and is referred to as a $B_{mix}$ dot. Accordingly, during the above described operation, the Y, M, C, and $B_k$ heads are controlled to produce the $B_k$ and $B_{mix}$ dots in an alternate order. As a result, each dot pitch of the $B_k$ and $B_{mix}$ dots is made twice the length of $D_p$ as shown in FIG. 15(*b*).

In this way, it is not necessary that each ink jet head be driven at a head drive frequency of twice the value of $F_{max}$ even when the carriage speed is set to twice the value of $V_c$, by controlling a plurality of ink jet heads to produce dots in an alternate order. As a result, reduction of the ink discharging amount $M_i$ can be avoided. Moreover, the so called white line print problem caused during a one hundred percent print duty cycle can be avoided.

Figure 16:
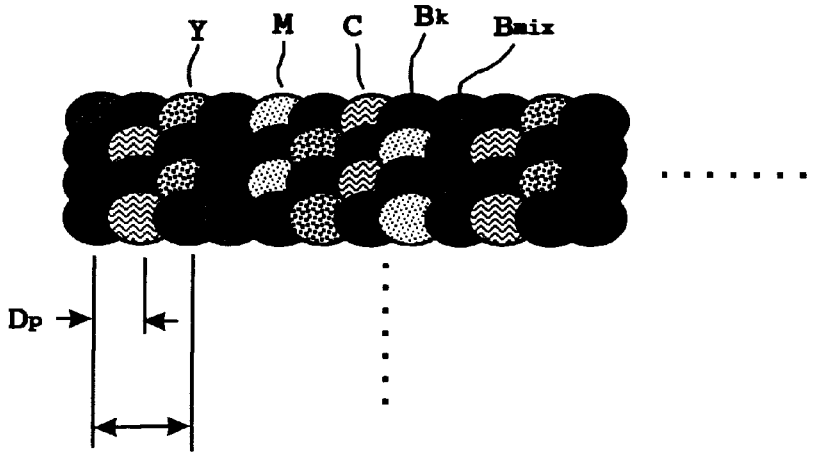

In addition, the Y, M, and C dots can additionally be inserted into an image made of $B_k$ and $B_{mix}$ dots which are placed in an alternate order as shown in FIG. 15(*b*), so that an image can be made of $B_k$ and other color dots including $B_{mix}$, Y, M, and C dots in an alternate order, as shown in FIG. 16. In this case, dots can be placed in various different orders such as an order in which $B_{mix}$, $B_k$, Y, $B_k$, C, $B_k$, and M dots are aligned, for example.

Figure 17:
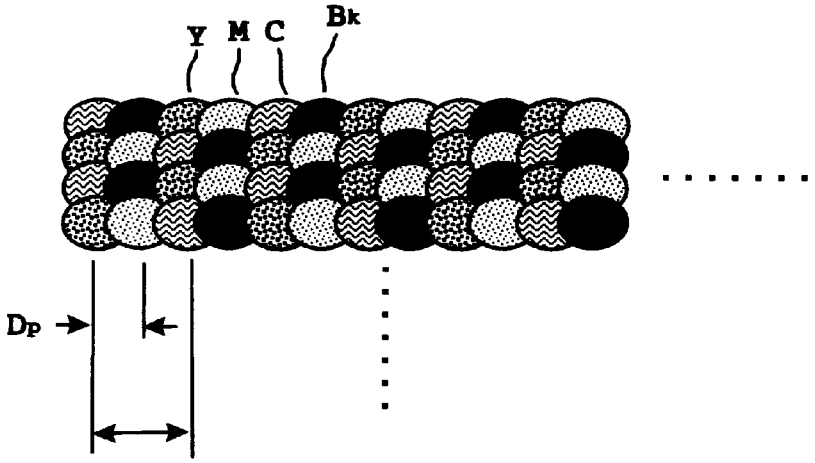

Further, in addition, Y, M, and C dots can additionally be inserted into an image made of $B_k$ dots, so that an image can be made of $B_k$, Y, M, and C dots in an alternate order, for example, as shown in FIG. 17. In this case, the density of the black color of the output image may be reduced to some extent in comparison with the cases shown in FIGS. 15(*b*) and 16. However, the dot pitch for each ink jet head can be increased to a value four times as large as the value of $D_p$ and, therefore, the carriage speed can be increased to a value four times as large as the value of $V_c$.

In this way, the head drive unit 100 of the ink jet recording apparatus 1000 can increase the speed of the printing operation without causing the white line problem.

Alternatively, the head drive unit 100 of the ink jet recording apparatus 1000 can perform the printing operation at a speed of $V_c$ with a reduced head drive frequency.

Ink used by the ink jet recording apparatus 1000 includes a temperature-sensitive characteristic, by which physical properties of the ink may be changed. In particular, ink increases viscosity with decreasing environmental temperature and, as a result, fluid resistance may be increased. Accordingly, the ink discharging amount $M_i$ may be greatly decreased as indicated by the dotted line shown in FIG. 10. To avoid this problem, the head drive unit 100 performs the printing operation at a speed of $V_c$ with a reduced head drive frequency.

In this case, the head drive unit 100 can be controlled to decrease the substantial head drive frequency to a half or a quarter of $F_{max}$ and to form an image with $B_k$, Y, M, C, and $B_{mix}$ dots in an alternate order, so as to compensate for the reduction of the ink discharging amount $M_i$ which is caused due to low environmental temperature. In this case, the head drive voltage is also adjusted so as to correct the ink discharging amount $M_i$ to an appropriate level in an efficient manner.

To achieve the above-described operation, the head drive unit 100 of the ink jet recording apparatus 1000 is provided with conditions in which values of head drive voltage $V_p$ and dot patterns have been predetermined in accordance with an environmental temperature around the ink jet heads. FIG. 18 shows an example of the conditions. Specifically, the first memory 113 stores predetermined reference data representing relationships between environmental temperature (ET) and the $V_p$ control signals $SV_p$1–$SV_p$3, as shown in FIG. 19. Further, the second memory 114 stores predetermined reference data which represents relationships between environmental temperature (ET) and an internal signal SELECT (not shown) for determining whether a dot pattern for forming an image is $B_k$ or $B_{mix}$ dot patterns, as shown in FIG. 20. The dot patterns included in the second memory 114 include a first dot pattern, including only the $B_k$ dot as shown in FIG. 12, and a second dot pattern, including the $B_k$ and $B_{mix}$ dots as shown in FIG. 15(*b*), the $B_k$, Y, M, and C dots as shown in FIG. 16, or the $B_k$, $B_{mix}$, Y, M, and C dots as shown in FIG. 17.

Based on an environmental temperature around the ink jet heads detected and outputted by the temperature sensor 116, the $V_p$ control signal generating unit 112 of the control unit 105 reads the $V_p$ control signals $SV_p$1–$SV_p$3 from the first memory 113 and sends these signals to the constant voltage generating circuit 106 which is provided in each one of the $B_k$, Y, M, and C head drive units 101–104. The $V_p$ control signals $SV_p$1–$SV_p$3 read from the first memory 113 can selectively specify a step of the head drive source voltage $V_s$ among eight steps of the head drive voltage $V_p$ through the circuit for controlling $V_s$ shown in FIG. 8, so as to specify the head drive voltage $V_p$ which appears at the junction A of FIG. 7. In this way, the head drive voltage $V_p$ can automatically be adjusted to an appropriate level in accordance with variations of environmental temperature around the ink jet heads using the first memory 113. Thus, reduction of ink discharging amount $M_i$ at a low temperature can be avoided.

Also, based on an environmental temperature around the ink jet heads detected and outputted by the temperature sensor 116, the print signal generating unit 115 reads a signal for selecting the first or second dot patterns from the second memory 114. When the dot pattern is the first dot pattern, the print signal generating unit 115 generates the print data signal DI that can form an image in a manner as shown in FIG. 13. The print data signal DI is then applied to the $B_k$ head drive unit 101 so that a print operation using only the $B_k$ head is performed. When the dot pattern is the second dot pattern, the print signal generating unit 115 generates the print data signal DI that can form an image in a manner as shown in FIGS. 15(*a*), 16, or 17. The print data signals DIs are then applied to the $B_k$, $B_{mix}$, Y, M, and C head drive units 101–104 so that a print operation using $B_k$, Y, M, and C is performed.

In this way, the head drive unit 100 of the ink jet recording apparatus 1000 automatically selects either the $B_k$ head only or the $B_k$ and the other heads in accordance with detection of environmental temperature around the ink jet heads. At a relatively low temperature, a selection of the $B_k$ and $B_{mix}$ heads, for example, is made and the $B_k$ and $B_{mix}$ dots are formed in an alternate order with the condition in which the substantial head drive frequency is reduced, so that reduction of the ink discharging amount $M_i$ is compensated for.

In this way, the ink jet recording apparatus 1000 can produce an output image of superior quality even at a relatively low temperature, avoiding reduction of the ink discharging amount.

Next, another example of the constant voltage generating circuit is described with reference to FIG. 21. The circuit shown in FIG. 21 is similar to that shown in FIG. 7, except for a portion enclosed by a dotted line.

Figure 21:
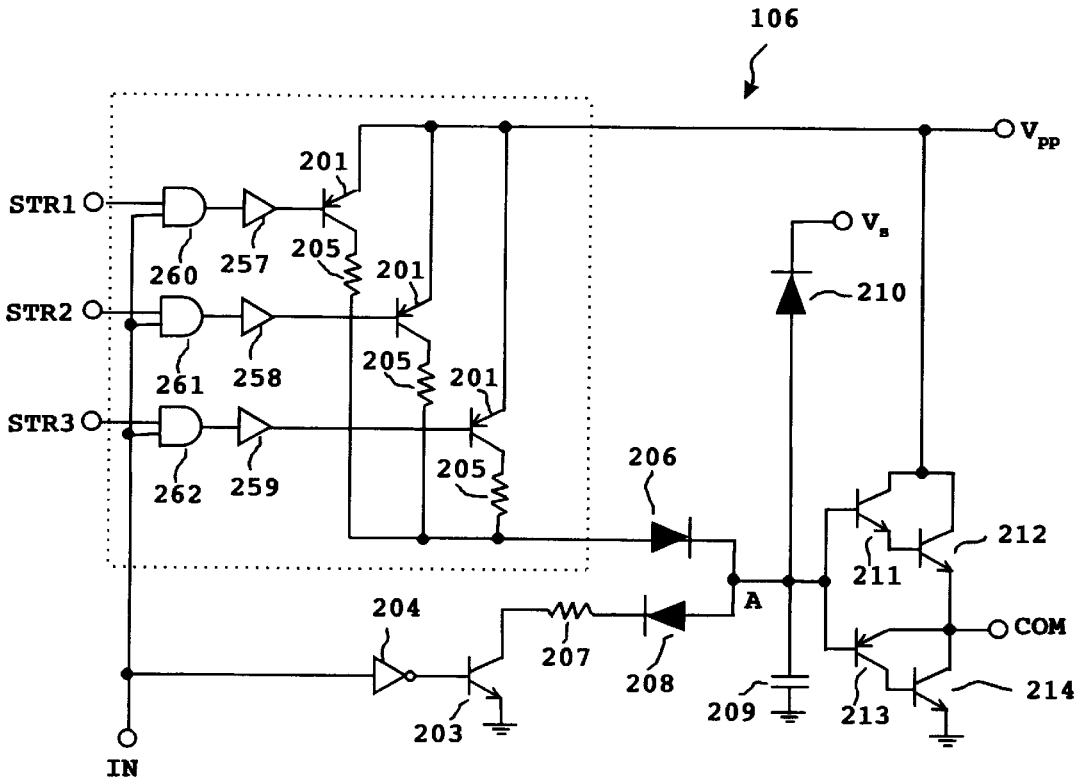
FIG. 21 is another exemplary circuit diagram of the constant voltage generating circuit used in the head drive unit.

The circuit of FIG. 21 is capable of performing an adjustment of the dot pitch $D_p$ by changing a rise time of the head drive voltage, in addition to the above-described adjustment of the ink discharging amount $M_i$ by varying the head drive voltage. More specifically, when a rise time of the head drive voltage is increased, an energy for discharging ink is increased and, as a result, a speed of the discharged ink is increased. In contrast, when a rise time of the head drive voltage is decreased, an energy for discharging ink is decreased and, as a result, a speed of the discharged ink is decreased.

This adjustment may be useful, particularly for a problem of variations in dot size. For example, when a black image quality or density in an image is desired to be increased, black ink to be used may preferably be of a non-osmotic type. On the other hand, an osmotic type ink may preferably be used for colors in order to avoid an event in which an osmosis may occur between adjacent colors. Since non-osmotic type ink has a higher viscosity than that of osmotic type ink, the size of the dots may differ. In this case, the size of the $B_k$ dot is smaller than that of the color dots.

In FIG. 21, charging resistors 251–253 connected to the diode 206, switching transistors 254–256 inserted between the source power $V_{pp}$ and the charging resistors 251 253, buffer circuits 257–259 connected to the bases of the switching transistors 254–256, and gate circuits 260–262 connected to the buffer circuits 257–259 are provided in the portion enclosed by the dotted line.

The gate circuits 260–262 are supplied by the control unit 105 with the signals STR1–STR3, respectively, as shown in FIG. 21. Also, the gate circuits 260–262 are commonly supplied by the control unit 105 with the head drive timing signal STB via input pin IN. During a time when the gate circuits 260–262 are supplied with the signals STR1–STR3 that are high signals, the signal STB can pass through the gate circuits 260–262 and reach the buffer circuits 257–259.

Receiving the STB signal, the buffer circuits 257–259 switch between an on state and an off state in accordance with the state of the STB signal. The switching transistors 254–256 can accordingly be switched between an on state and an off state in accordance with the STB signal. During the on state of the switching transistors 254–256, the source power $V_{pp}$ is applied to the respective charging resistors 251–253 through the emitters of the switching transistors 254–256 that are in the on state.

In the circuit of FIG. 21, the charging resistors 251–253 have a total resistor value which is a sum of the values of the individual charging resistors 251–253. Such a total value can be changed to eight stepped values depending upon the combination of the charging resistors 251–253 that are supplied with the source power $V_{pp}$ in a way as described above.

Since the charging resistors 251–253 that can be changed to the eight stepped values and the capacitor 209 form a circuit for determining a time constant TR, the time constant TR can be changed to eight stepped time constant values. That is, a desired value can be selected from among the eight stepped time constant values using the signals STR1–STR3. Accordingly, the rise time of the head drive voltage can be changed to eight stepped values and the dot pitch can be thereby adjusted on a demand basis.

In this way, a difference of dot pitch between adjacent dots can be adjusted by changing a rise time of the head drive voltage.

Figure 22A:
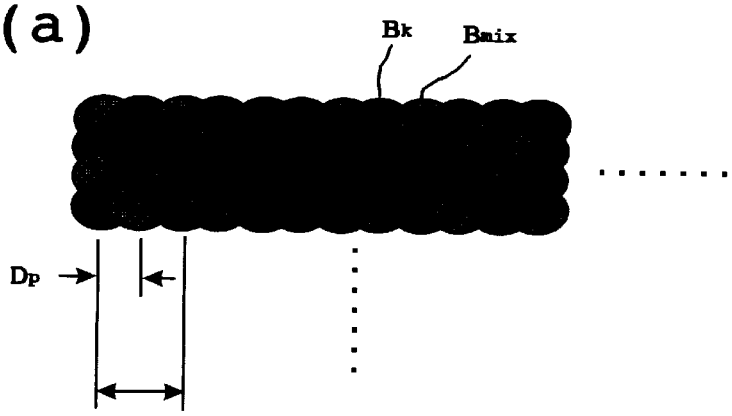
FIGS. 22(*a*)–22(*c*) are illustrations for explaining ways of positioning dots in a case of using a plurality of inks in different colors performed with the constant voltage generating circuit show in FIG. 21.
Figure 22B:
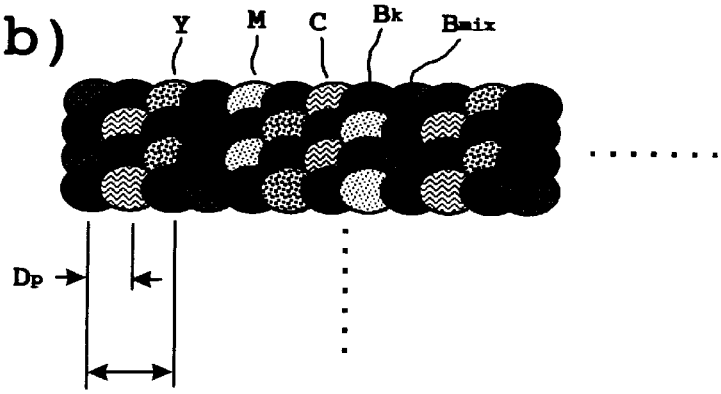
Figure 22C:
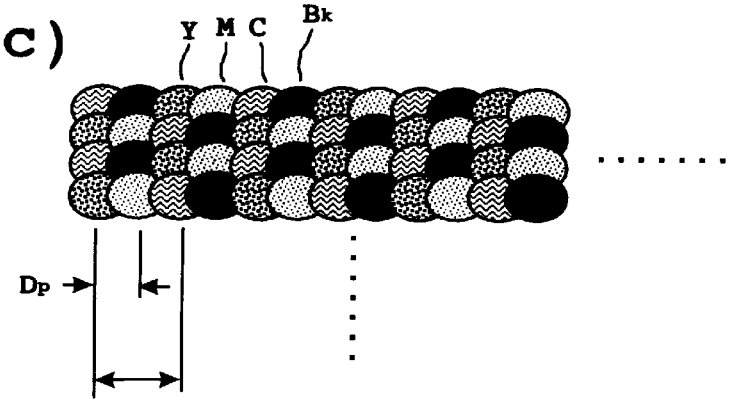

When the above-mentioned adjustment of dot pitch is conducted in combination with the adjustment of the head drive voltage, a more precise adjustment of image quality can be performed. FIGS. 22(*a*)–22(*c*) show examples of an output image made of the $B_k$ and $B_{mix}$ dots in an alternate order, the $B_k$, $B_{mix}$, and other color dots in an alternate order, and the $B_k$ and other color dots in an alternate order, respectively. These output images are substantially close to those shown in FIGS. 15(*a*), 16, and 17, respectively.

In addition, the ink jet recording apparatus 1000 may preferably be provided with, for example, a switch or a user selection program using a display for selecting a dot pattern from among the first dot pattern and the second dot pattern which are stored in the first and second memories, respectively. As an alternative, the selection of the dot pattern can be made by a command to be sent from an external host system.

Figure 23:
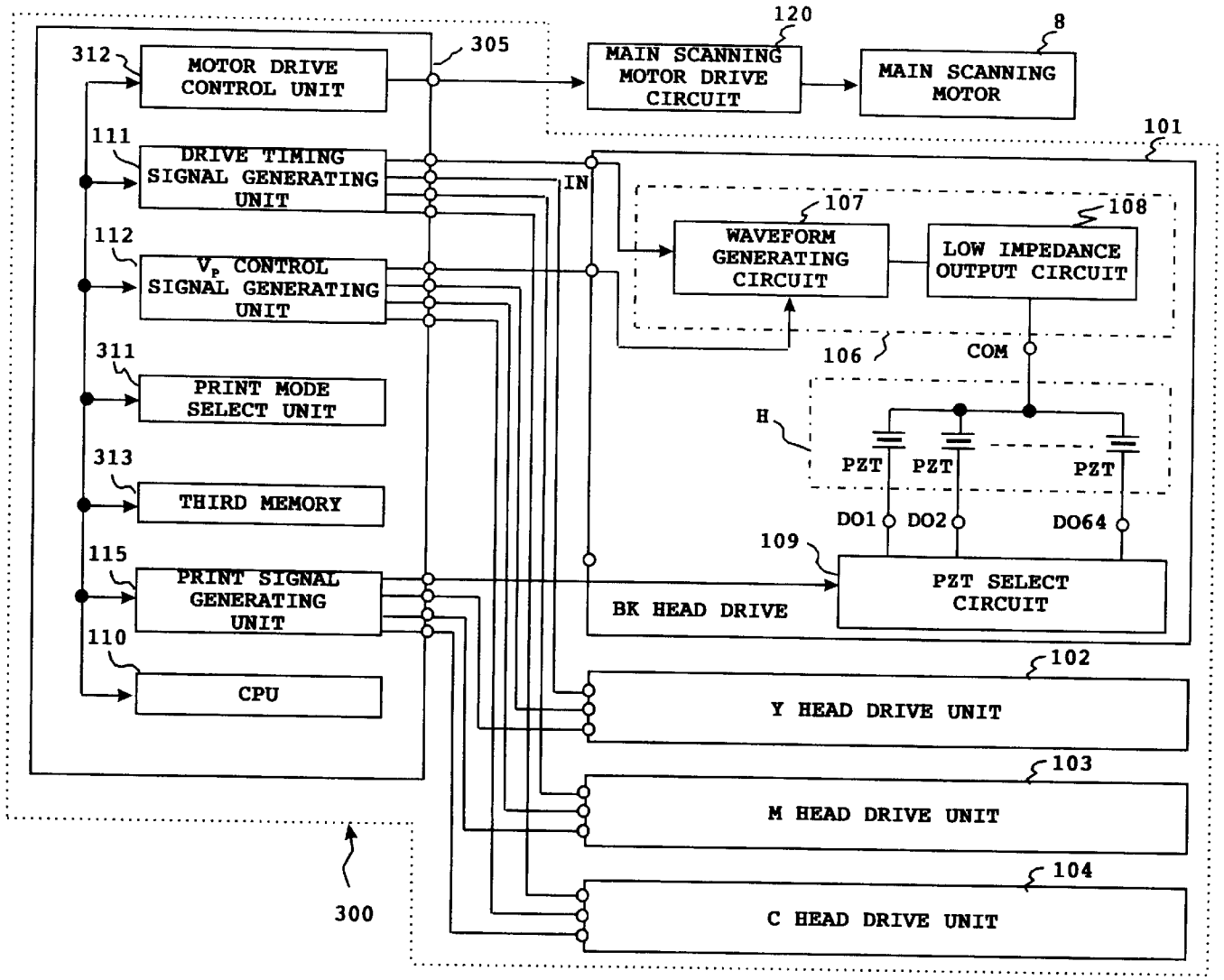
FIG. 23 is a block diagram of an example of a first modified head drive unit of the ink jet recording apparatus shown in FIG. 1.

Next, a modified head drive unit 300 according to another embodiment of the present invention is explained with reference to FIG. 23. The modified head drive unit 300 is capable of switching between high speed print and high quality print modes in accordance with a user instruction. FIG. 23 shows a main scanning motor 8, a main scanning motor drive circuit 120, and the modified head drive unit 300.

The head drive unit 300 is similar to the head drive unit 100 shown in FIG. 6, except for a modified control unit 305. The modified control unit 305 of FIG. 23 is similar to the control unit 105 shown in FIG. 6, except for a print mode select unit 311 for selecting either one of the high speed print and high quality print modes, a motor drive control unit 312 for controlling the main scanning motor drive circuit 120 that drives the main scanning motor 8, and a third memory 313.

The print mode select unit 311 selects either one of the high speed print and high quality print mode in accordance with a print mode select signal sent from a switch or a program provided in the ink jet recording apparatus 1000. The motor drive control unit 312 drives the main scanning motor 8 via the main scanning motor drive circuit 120 at a scanning speed in accordance with the selected print mode, thereby driving the carriage 4 (FIG. 1). The third memory 313 stores data representing relationships between the print modes, the dot patterns, and the carriage speed relative to the head drive frequency, in accordance with an example of a data table as shown in FIG. 24. In addition, the print signal generating unit 115 generates the print data DI for forming an image made of the first or second dot patterns in accordance with the selected print mode.

Having the thus-arranged control unit 305, the first modified head drive unit 300 of the ink jet recording apparatus 1000 performs a head driving operation in the following manner. When the ink jet recording apparatus 1000 is provided with the high quality print mode, in which an output image is produced at the conditions of an image resolution of 600 dpi (dot per inch), meaning that the dot pitch is set to 42.3 $\mu$m, a head drive frequency of 16 kHz ($F_{max}$), and a carriage speed of 677 mm per second are used, for example. The relationship of $D_p = V_c \times 1/F_{max}$ is already fulfilled by the aforementioned conditions, in a case that the printing operation is performed by means of using the first dot pattern by which an output image is formed by the $B_k$ head only.

In this case, the ink jet recording apparatus 1000 may have a problem if it is set to the high speed print mode in which an output image is produced at the conditions of an image resolution of 600 dpi (dot per inch), a head drive frequency of 16 kHz, and a carriage speed of twice the value used in the high quality print mode, for example. More specifically, when the carriage speed is increased to twice the value used in the high quality print mode which is 1354 mm per second, the head drive frequency $F_{max}$ is needed to be changed accordingly so as not to deviate from the relationship of $D_p=V_c\times 1/F_{max}$. In this case, the head drive frequency $F_{max}$ is needed to be increased to at least 32 kHz, which is twice as great as the value used in the high quality print mode, and the image resolution can be maintained at 600 dpi ($D_p$=42.3 $\mu$m). However, in this case, the problem such as reduction of the ink discharging amount or the so-called white line print may be caused due to the high head drive frequency ($2\times F_{max}$) for the reasons as described above.

Alternatively, in order to avoid deviating from the relationship of $D_p=V_c\times 1/F_{max}$, an image resolution of 600 dpi ($D_p$=42.3$\mu$m) may be decreased to 300 dpi ($D_p$=84.6$\mu$m), for example, which is half of the value used in the high quality print mode, and the head drive frequency is maintained at 16 kHz ($F_{max}$) However, in this case, a problem such as reduction of the ink discharging amount or the so-called white line print may also occur, due to the dot pitch ($D_p$=84.6$\mu$m) which is twice as large as the value used in the high quality print mode. That is, to satisfy such a twice as large dot pitch, a dot size is required to be at least twice as great as the value used in the high quality print mode, which can not be fulfilled in terms of the ink discharging amount.

In order to avoid the above-mentioned problems, the ink jet recording apparatus 1000 is arranged to perform a print operation in the high speed print mode, having the conditions of a head drive frequency of 16 kHz ($F_{max}$), an image resolution of 600 dpi, and a carriage speed of 1354 mm per second ($2\times V_c$), by using the second dot pattern by which the $B_k$ dot and the $B_{mix}$ or other color dots can be formed in an alternate order.

In the high speed print mode, the print mode select unit 311 selects the high speed print mode and accordingly sends signals to the motor drive control unit 312 and the print signal generating unit 115. Then, the motor drive control unit 312 uses appropriate data for the high speed print mode from the third memory 313 to set a value of the carriage speed to 1354 mm per second ($2\times V_c$), so as to drive the main scanning motor 8 at that speed via the main scanning motor drive circuit 120. At the same time, the print signal generating unit 115 generates the print data signal DI by which an image can be formed with the $B_k$ dot and the $B_{mix}$ or other color dots in an alternate order through the respective head drive units. At this time, since the head drive frequency is set to 16 kHz ($F_{max}$), reduction of the ink discharging amount can be avoided. Thus, the ink jet recording apparatus 1000 can produce a superior quality output image in the high speed print mode, without causing the problem such as reduction of the ink discharging amount or the so-called white line print.

Alternatively, the ink jet recording apparatus 1000 may be provided with a high quality print mode having the conditions of an image resolution of 600 dpi, a head drive frequency of 8 kHz ($\frac{1}{2}\times F_{max}$), and a carriage speed of 338.5 mm per second. These conditions satisfy the relationship of $D_p=V_c\times 1/F_{max}$. In this case, the high speed print mode can be provided at an image resolution of 600 dpi, a head drive frequency of 8 kHz ($\frac{1}{2}\times F_{max}$), and a carriage speed of 1354 mm per second which is four times as great as the value used in the high quality print mode. By the thus-arranged conditions, the print speed in the high speed print mode can be set to four times as fast as the print speed in the high quality print mode.

Figure 25:
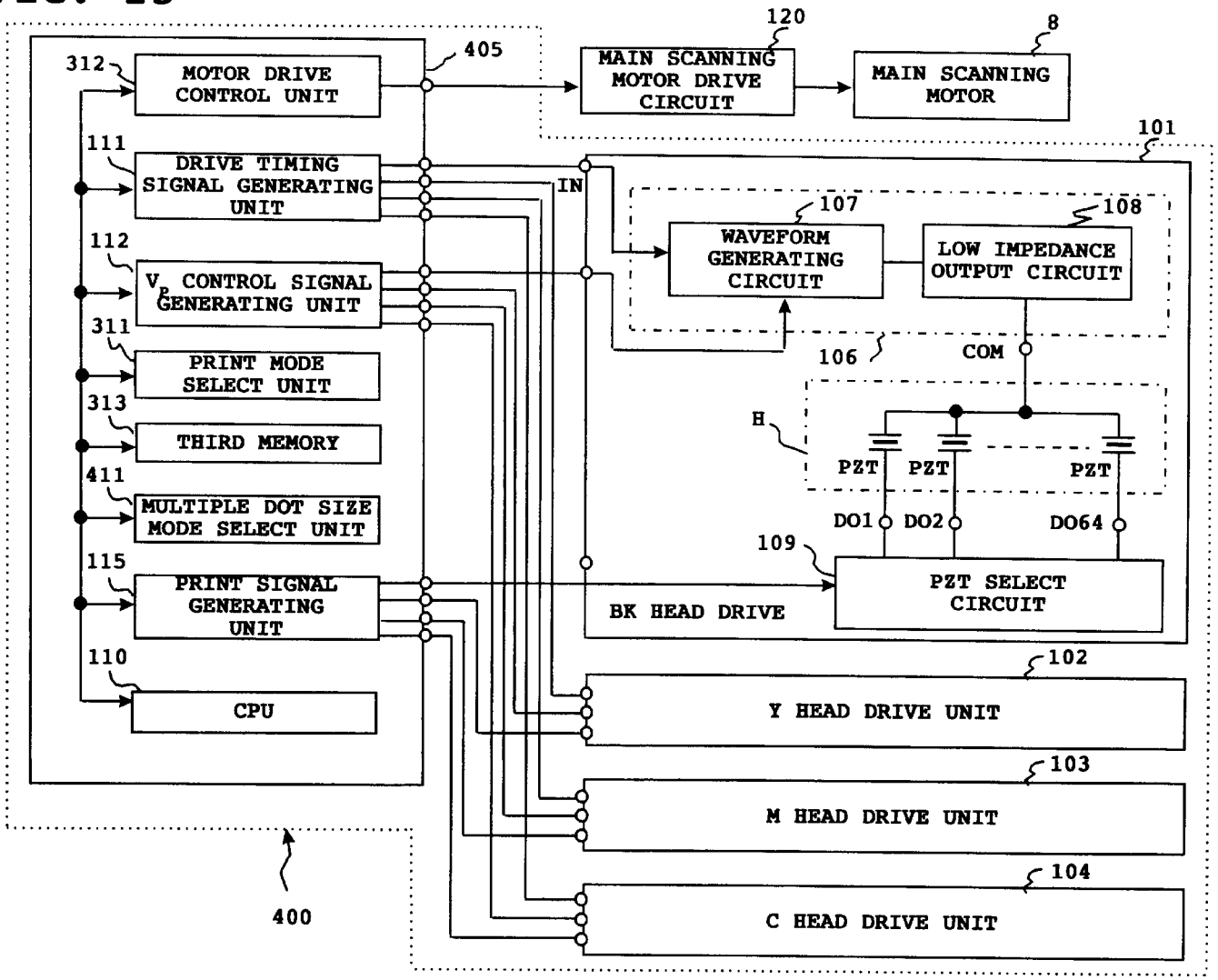
FIG. 25 is a block diagram of an example of a second modified head drive unit of the ink jet recording apparatus shown in FIG. 1.

Next, a modified head drive unit 400 of the ink jet recording apparatus 1000 according to another embodiment of the present invention is explained with reference to FIGS. 25–29. The modified head drive unit 400 of FIG. 25 is capable of switching between standard and multiple dot size modes in accordance with a user instruction provided through a switch, a program using a display, or the like. The modified head drive unit 400 of FIG. 25 is similar to the head drive unit 300 shown in FIG. 23, except for a modified control unit 405. The modified control unit 405 is similar to the modified control unit 305, except for a multiple dot size mode select unit 411. The multiple dot size mode select unit 411 switches between the standard and multiple dot size modes in accordance with a user instruction. During the standard dot size mode, an ink dot is formed in a single size as in the cases of the first and second control units 105 and 305 in which the dot size is fixed. In the multiple dot size mode, an ink dot can be formed in various sizes.

Figure 26:
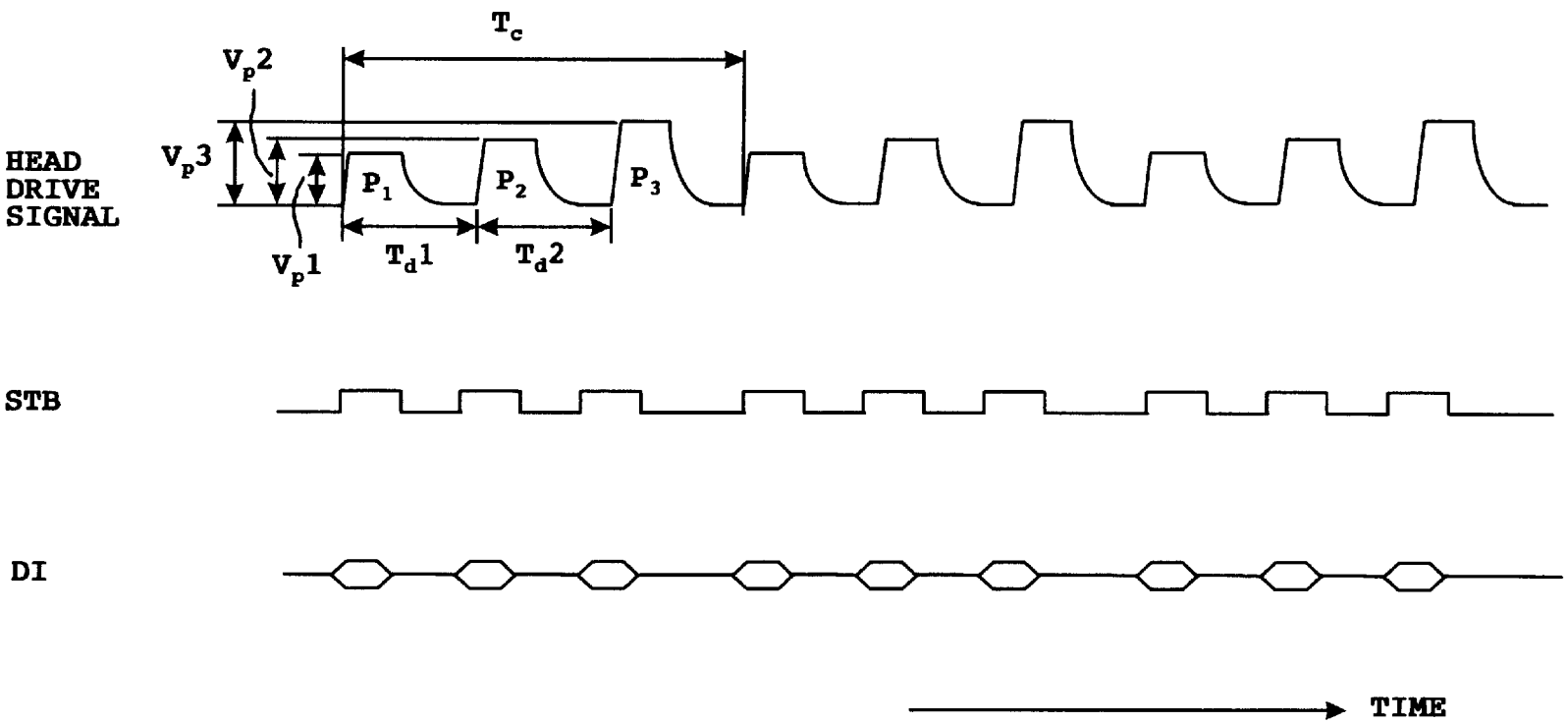
FIG. 26 is a timing chart for explaining a signal cycle including different head drive pulses.

FIG. 26 shows the head drive signal having a three-stepped-voltage by which a dot size can be varied into various sizes. When selecting the multiple dot size mode in accordance with a user instruction, the multiple dot size mode select unit 411 instructs the drive timing signal generating unit 111, the $V_p$ control signal generating unit 112, and the print signal generating unit 115 to generate the respective signals in a cycle of a predetermined time $T_c$.

In one $T_c$-length cycle during this operation, the head drive signal including waveforms $P_1$, $P_2$, and $P_3$ having head drive voltages $V_{p1}$, $V_{p2}$, and $V_{p3}$, respectively, is generated in the respective constant voltage driving circuits 106, as shown in FIG. 26. The waveforms $P_1$, $P_2$, and $P_3$ have a relationship of $P_1<P_2<P_3$, and the head drive voltages $V_{p1}$, $V_{p2}$, and $V_{p3}$ have a relationship of $V_{p1}<V_{p2}<V_{p3}$. Further, in one $T_c$-length cycle during this operation, the drive timing signal generating unit 111 generates the head drive timing signal STB that includes three STB pulses, as shown in FIG. 26. Further, in-one $T_c$-length cycle during this operation, the print signal generating unit 115 generates the print signal DI that includes three pulses in accordance with the dot sizes required to form an output image, as shown in FIG. 26. In addition, a delay time between the waveforms $P_1$ and $P_2$ is referred to as $T_{d1}$ and another delay time between $P_2$ and $P_3$ is referred to as $T_{d2}$. When the carriage 4 (FIG. 1) moves at a speed of $V_c$ during the above-described operation and a pitch between adjacent picture elements is referred to as $G_p$, a relationship of $V_c=G_p\times T_c$ is satisfied.

Generally, in the ink jet recording apparatus, the ink discharging amount $M_i$ is increased when the head drive voltage $V_p$ is increased and the dot size is increased when the ink discharging amount $M_i$ is increased. Accordingly, when ink is discharged with the waveforms $P_1$, $P_2$, and $P_3$, the ink discharging amounts are varied and are referred to as $M_{i1}$, $M_{i2}$, and $M_{i3}$. In this case, ink discharging amounts $M_{i1}$, $M_{i2}$, and $M_{i3}$ have a relationship of $M_{i1}<M_{i2}<M_{i3}$. Resultant dots are referred to as $P_{d1}$, $P_{d2}$, and $P_{d3}$, respectively. In this way, the dot size can be varied.

Figure 27:
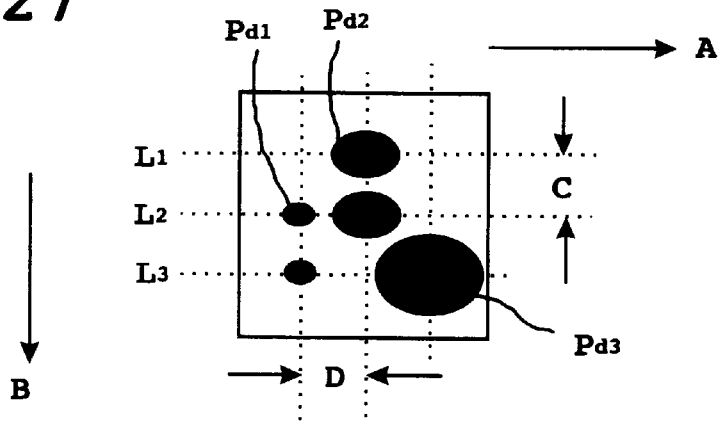
FIGS. 27–29 are illustrations for explaining ways of controlling a dot pitch.

As a feature of such a variation in dot size, the control unit 405 is capable of forming an image with a gray scale. FIG. 27 shows an illustration for explaining a picture element framed by 3×3 dots, for example, for forming a gray scale image. In FIG. 27, letters A, B, C, and D represent the main scanning direction, the sub-scanning direction, a dot pitch in the sub-scanning direction, and a dot pitch $D_p$ in the main scanning direction, respectively. The thus-framed picture element can be formed in the following manner. First, a dot $P_{d2}$ is formed with the head drive voltage $V_{p2}$ by the waveform $P_2$ on a first line $L_1$ of the picture element. Then, the sub-scanning movement to a second line $L_2$ is performed and a dot $P_{d1}$ and a dot $P_{d2}$ are formed with the head drive voltages $V_{p1}$ and $V_{p2}$, respectively, by the waveforms $P_1$ and $P_2$ (FIG. 26), respectively, on the second line $L_2$. Then, the sub-scanning movement to a third line $L_3$ is performed and a dot $P_{d1}$ and a dot $P_{d3}$ are formed with the head drive voltages $V_{p1}$ and $V_{p3}$, respectively, by the waveforms $P_2$ and $P_3$ (FIG. 26), respectively, on the third line $L_3$.

The above-described method can be performed when a nozzle pitch $N_p$ (that is, a distance between adjacent ink jet nozzles) is greater than the dot pitch $D_p$. However, when the nozzle pitch $N_p$ is substantially equal to the dot pitch $D_p$, the dot forming operation on the lines $L_1$, $L_2$, and $L_3$ may be performed during one main scanning movement without performing the subscanning movement.

In this way, the control unit 405 can easily form a 3-by-3 picture element made of three different sized dots for forming a relatively finer gray scale picture.

Figure 28:
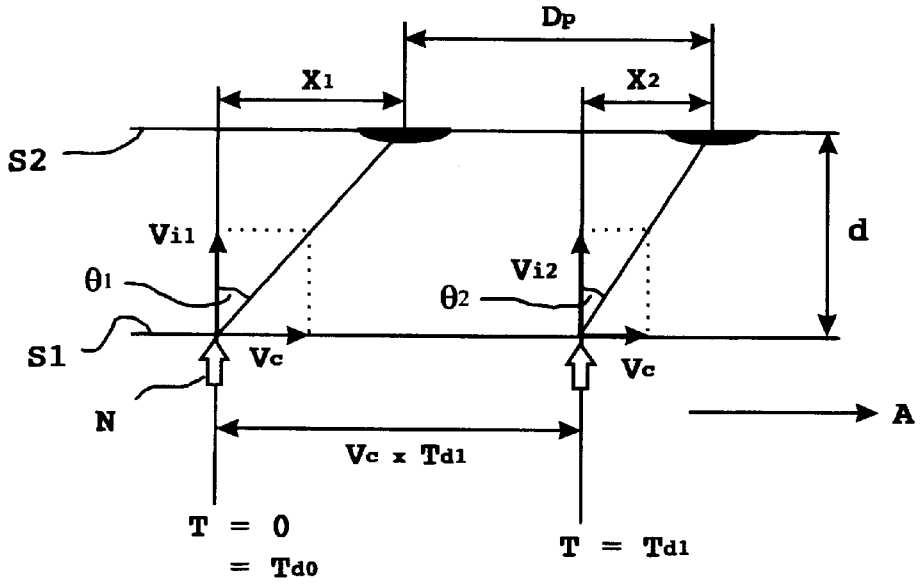

In FIG. 27, dot pitches between adjacent dots, to be formed within the picture element during the above-mentioned operation, are preferably equal to each other. To form dots with an equal dot pitch between adjacent dots within the picture element, a predetermined delay time $T_{d1}$ is set between the waveforms $P_1$ and $P_2$ and a predetermined time $T_{d2}$ is set between the waveforms $P_2$ and $P_3$, as shown in FIG. 26. More specifically, a way of adjusting a dot pitch is explained with reference to FIG. 28. In FIG. 28, the various conditions are set in the following manner: the ink discharged by the waveforms $P_1$ and $P_2$ have a speed of $V_{i1}$ and $V_{i2}$, respectively; the waveforms $P_1$ and $P_2$ have the predetermined delay time $T_{d1}$; a surface of the nozzle (indicated by a letter S1) and a surface of a recording sheet (indicated by a letter S2) have a distance d therebetween; and the carriage 4 moves in the main scanning direction (indicated by a letter A) at a speed of $V_c$. In addition, a nozzle position is indicated by a letter N. Further, an angle between a line including an ink discharging point at a time of $T_{do}$, forming a right angle with Si, and another line including the ink discharging point at a time of $T_{do}$ and a point on S2, at which a dot is formed, is referred to as θ1. Also, another angle between a line including an ink discharging point at a time of $T_{d1}$, forming a right angle with S1, and another line including the ink discharging point at a time of $T_{d1}$ and a point on S2 at which another dot is formed is referred to as θ2. Under these conditions, when a distance between a point of intersection of S1 and a line including an ink discharging point at a time of $T_{do}$, forming a right angle, and a point on the recording sheet, at which the discharged ink is formed, is referred to as X1, X1 is represented by the following equation:

$$X1=\tan\theta 1\times d=V_c/V_{i1}\times d. \quad (1)$$

Further, under these conditions, a distance $X_2$ between a point of intersection of a plain including an ink discharging point at a time of $T_{d1}$ and the recording sheet, forming a right angle, and a point on the recording sheet at which the discharged ink is formed is represented by the following equation:

$$X1=\tan\theta 2\times d=V_c/V_{i2}\times d. \quad (2)$$

Accordingly, a dot pitch $D_p$ (that is, a distance between dots formed on the recording sheet using the waveforms $P_1$ and $P_2$) is represented by the following equation:

$$D_p=V_c\times T_{d1}-X_1+X_2=(T_{d1}-d/V_{i1}+d/V_{i2})\times V_c. \quad (3)$$

As described above, the dot pitch is preferably equal to each other within a picture element. When the 3-by-3 picture element is used, it is preferable that $D_p$ and $G_p$ satisfy an equation:

$$G_p=3\times D_p. \quad (4)$$

From the above equations, the delay time $T_{d1}$ between the waveforms $P_1$ and $P_2$ is obtained by the following equation:

$$T_{d1}=G_p/(3V_c)+(1/V_{i1}-1/V_{i2})\times d. \quad (5)$$

Further, from the above equations, the delay time $T_{d2}$ between the waveforms $P_2$ and $P_3$ is obtained by the following equation:

$$T_{d2}=G_p/(3V_c)+(1/V_{i2}-1/V_{i3})\times d. \quad (6)$$

These equations for determining the delay times $T_{d1}$ and $T_{d2}$ can be generalized in the following equation in which a number n is a number of dots to be disposed in the main scanning and sub-scanning directions relative to a picture element and a number K varies from 1 to (n−1)

$$T_{d(k)}=G_p/(nV_c)+(1/V_{i(k)}-1/V_{i(k+1)})\times d \quad (7)$$

By using the above-described equation, the dot pitches between the adjacent dots can be made equal to each other within a picture element. Thereby, as another feature of the control unit 405, when three contiguous dots $P_{d1}$, $P_{d2}$, and $P_{d3}$ to be produced within a cycle time for a picture element are produced to form a picture element, the dot size between adjacent dots within the picture element can equally be adjusted.

Figure 29:
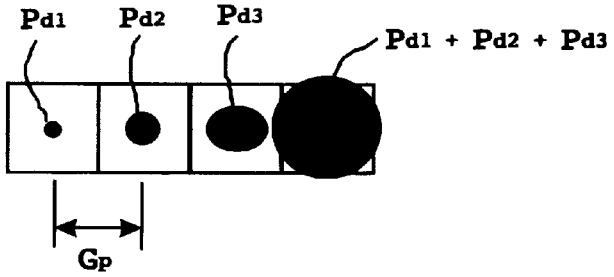

FIG. 29 shows a way of forming a dot having a dot size greater than those of $P_{d1}$, $P_{d2}$, and $P_{d3}$. When the discharged ink activated by the waveforms $P_1$, $P_2$, and $P_3$, respectively, are controlled to form dots at the same point on the recording sheet, a dot having a dot size greater than those of $P_{d1}$, $P_{d2}$, and $P_{d3}$ is created, as shown in FIG. 29. In order to form dots at the same point on the recording sheet, $D_p$ is set to 0 in the above-described equation (3) and, as a result, the following equations for $T_{d1}$ and $T_{d2}$ are obtained:

$$T_{d1}=(1/V_{i1}-1/V_{i2})\times d, \quad (8)$$

and $$T_{d2}=(1/V_{i2}-1/V_{i3})\times d, \quad (9)$$

For example, when speeds of the discharged ink $V_{i1}$, $V_{i2}$, and $V_{i3}$ activated by the waveforms $P_1$, $P_2$, and $P_3$ are set to 4, 5, and 6 m/s, respectively, and the distance between the recording sheet and the nozzle is set to 1 mm, the delay times $T_{d1}$ and $T_{d2}$ are 50 and 33.3 μs, respectively.

By using the above-described equation, the dot pitches between the adjacent dots within a picture element can be made 0. Thereby, as another feature of the control unit 405, three contiguous dots $P_{d1}$, $P_{d2}$, and $P_{d3}$ to be produced within a time for a picture element can be overlaid at a same point within a picture element so as to form a dot having a relatively greater size than $P_{d1}$, $P_{d2}$, or $P_{d3}$, as shown in FIG. 29.

An equation for overlaying three contiguous dots $P_{d1}$, $P_{d2}$, and $P_{d3}$ at a same point within a picture element can be generalized in the following manner in which a number n is a number of dots to be disposed in the main scanning and sub-scanning directions relative to a picture element and a number K varies from 1 to (n−1):

$$T_{d(k)}=(1/V_{i(k)}-1/V_{i(k+1)})\times d \quad (10)$$

Figure 30A:
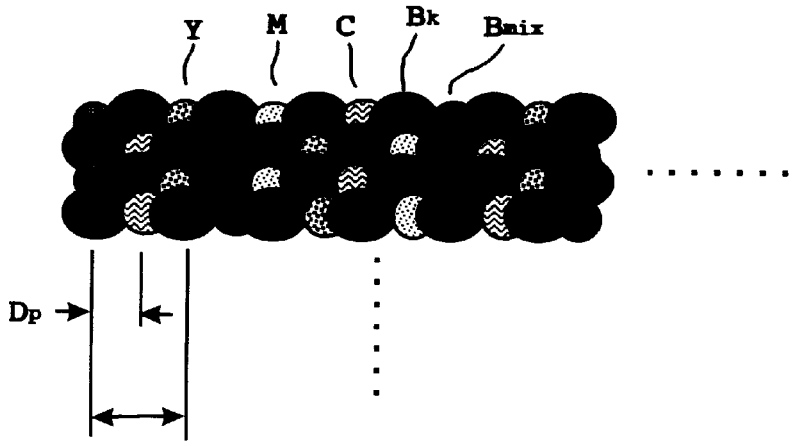
FIG. 30(*a*)–30(*b*) are illustrations for explaining ways of improving blackness of images of FIGS. 22(*a*) and 22(*b*).
Figure 30B:
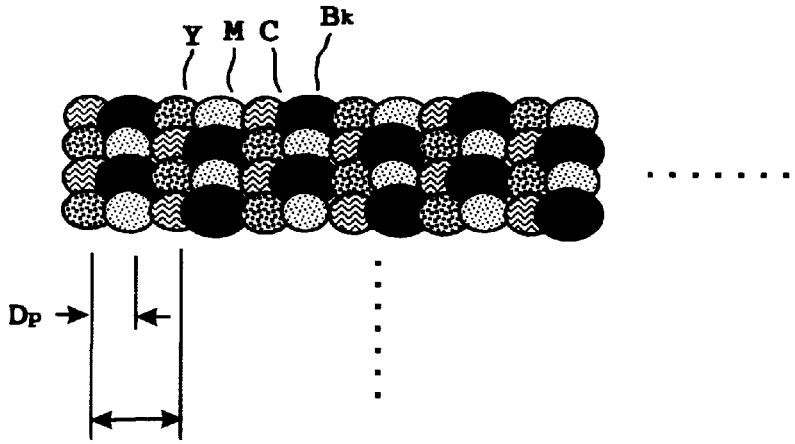

Next, a way of improving blackness of an output image made of the $B_k$, $B_{mix}$, and other color dots or the $B_k$ and other color dots in an alternate order using the above-described control unit 405 is explained with reference to FIGS. 30(*a*) and 30(*b*). FIG. 30(*a*) is an example of an output image which is made of the $B_k$, $B_{mix}$, and other color dots and which is to be produced in a similar manner as the output image shown in FIG. 22(*b*). Since each of the images shown in FIGS. 22(*b*) and 30(*a*) includes $B_{mix}$, Y, C, and M dots, blackness of the image is lower than that of an image formed only with $B_k$ dots. However, $B_{mix}$, Y, M, and C dots are arranged to be smaller than $B_k$ dots in the image of FIG. 30(*a*), an area shared by $B_k$ dots are larger than that shared by $B_{mix}$, Y, M, and C dots and, consequently, the blackness of the image of FIG. 30(*a*) is higher than that of the image shown in FIG. 22(*b*). FIG. 30(*b*) shows an example of a way of increasing blackness of the image of FIG. 22(*c*). In this case, each of $B_k$ dots is formed as the $P_{d3}$ and each of other color dots is formed as the $P_{d1}$, for example. As a result, the $B_k$ dots are formed in a relatively large size and other color dots are formed in a relatively small size, as shown in FIG. 30(*b*). Consequently, the blackness of the image of FIG. 30(*b*) is higher than that of the image shown in FIG. 22(*c*).

In this way, the above-described control unit 405 can improve blackness of an output image when the output image is made of the $B_k$, $B_{mix}$, and other color dots or the $B_k$ and other color dots in an alternate order.

This invention may be conveniently implemented using a conventional general purpose digital computer programmed according to the teachings of the present specification, as will be apparent to those skilled in the computer arts. Appropriate software coding can readily be prepared by skilled programmers based on the teachings of the present disclosure, as will be apparent to those skilled in the software arts. The present invention may also be implemented by the preparation of application-specific integrated circuits or by interconnecting an appropriate network of conventional component circuits, as will be readily apparent to those skilled in the art.

Obviously, numerous additional modifications and variations of the present invention are possible in light of the above teachings. It is therefore to be understood that within the scope of the appended claims, the present invention may be practiced otherwise than as specifically described herein.

What we claim is:

1. An ink jet recording apparatus, comprising:

a carriage;

a plurality of ink jet heads mounted on said carriage and including first, second, and successive ink jet heads respectively using first, second, and successive color ink for making dots in first, second, and successive colors, respectively;

head drive means for selectively driving said plurality of ink jet heads at a variable head drive frequency;

carriage drive means for driving said carriage at a variable carriage drive speed;

mode selecting means for selecting a multiple-head monochrome print mode in which a monochrome print operation is performed by alternatively driving said first ink jet head and at least one of said second and successive ink jet heads, wherein an image is formed in such a way that a dot in said first color and at least one of dots in said second and successive colors are positioned in an alternating sequence; and control means for controlling said head drive means to perform a monochrome print operation in said multiple-head monochrome print mode and to adjust said variable head drive frequency from a first level to a second level which is equal to or lower than said first level and for controlling said carriage drive means to adjust said variable carriage drive speed from a first level to a second level which exceeds said first level, when said multiple-head monochrome print mode is selected by said mode selecting means, wherein said first, second, and successive color inks are black, yellow, magenta, and cyan, respectively, and during said monochrome print operation in said multiple-head monochrome print mode, said control means controls said head drive means to drive said ink jet heads to successively form dots in such a way that a black ink dot made of said black ink and at least one of a yellow ink dot made of yellow ink, a magenta ink dot made of magenta ink, and a cyan ink dot made of cyan ink, and a blended-black dot made of said yellow, magenta, and cyan ink are positioned in an alternating sequence, and said control means controlling said carriage drive means to drive said carriage at said second level of said variable carriage drive speed which is twice as fast as said first level of said variable carriage drive speed.

2. The ink jet recording apparatus according to claim 1, wherein said mode selecting means automatically selects said multiple-head monochrome print mode when:

said first level of said variable head drive frequency is a maximum head drive frequency;

each one of said plurality of ink jet heads driven at said maximum head drive frequency forms dots with a dot pitch between adjacent dots in a main scanning direction corresponding to an image resolution when said carriage is driven at said first level of said variable carriage drive speed; and one of an equation:

$$D_p = V_{c1} \times 1/F_{max}$$

where $D_p$ is said dot pitch, $V_{c1}$ is said first level of said variable carriage drive speed, and $F_{max}$ is said maximum head drive frequency and another equation:

$$D_p = V_{c2} \times 1/F_2$$

where $D_p$ is said dot pitch, $V_{c2}$ is said second level of said variable carriage drive speed, and $F_2$ is said second level of said variable head drive frequency, said $D_p$ corresponding to an image resolution is satisfied.

3. The ink jet recording apparatus according to claim 1, wherein said first, second, and successive color inks are black, yellow, magenta, and cyan, respectively, and during said monochrome print operation in said multiple-head monochrome print mode, said control means is also capable of operating in a mode which controls said head drive means to drive said ink jet heads to successively form dots in such a way that a black ink dot made of said black ink and a blended-black dot made of said yellow, magenta, and cyan ink are positioned in an alternating sequence and said control means controls said carriage drive means to drive said carriage at said second level of said variable carriage drive speed which is twice as fast as said first level of said variable carriage drive speed.

4. The ink jet recording apparatus according to claim 1, further comprising head drive power varying means for varying a head drive power to a relatively high power for driving said first ink jet head and to a relatively low power for driving said second and successive ink jet heads, and wherein said monochrome print operation in said multiple-head monochrome print mode is performed by alternatively driving said first ink jet head at said relatively high power and at least one of said second and successive ink jet heads at said relatively low power and wherein an image is formed in such a way that a relatively large dot in said first color and a relatively small dot in said second and successive colors are positioned in an alternating sequence.

5. The ink jet recording apparatus according to claim 1, wherein said first, second, and successive color inks are black, yellow, magenta, and cyan, respectively, and during said monochrome print operation in said multiple-head monochrome print mode, said control means is also capable of operating in a mode which controls said head drive means to drive said ink jet heads to successively form dots in such a way that a black ink dot made of black ink, a yellow ink dot made of yellow ink, a magenta ink dot made of magenta ink, and a cyan ink dot made of cyan ink are positioned in an alternating sequence, and said control means controls said carriage drive means to drive said carriage at said second level of said variable carriage drive speed which is four times as fast as said first level of said variable carriage drive speed.

6. An ink jet recording apparatus comprising:

a carriage;

a plurality of ink jet heads mounted on said carriage and including first, second, and successive ink jet heads respectively using first, second, and successive color ink for making dots in first, second, and successive colors, respectively;

head drive means for selectively driving said plurality of ink jet heads at a variable head drive frequency;

carriage drive means for driving said carriage at a variable carriage drive speed;

mode selecting means for selecting a multiple-head monochrome print mode in which a monochrome print operation is performed by alternatively driving said first ink jet head and at least one of said second and successive ink jet heads, wherein an image is formed in such a way that a dot in said first color and at least one of dots in said second and successive colors are positioned in an alternating sequence; and control means for controlling said head drive means to perform said monochrome print operation in said multiple-head monochrome print mode and to adjust said variable head drive frequency from a first level to a second level which is equal to or lower than said first level and for controlling said carriage drive means to adjust said variable carriage drive speed from a first level to a second level which is slower than said first level, when said multiple-head monochrome print mode is selected by said mode selecting means, wherein said first, second, and successive color inks are black, yellow, magenta, and cyan, respectively, and during said monochrome print operation in said multiple-head monochrome print mode, said control means controls said head drive means to drive said ink jet heads at said second level of said variable head drive frequency which is equal to or lower than a half of said first level of said variable head drive frequency to successively form dots in such a way that a black ink dot made of black ink and at least one of a yellow ink dot made of yellow ink, a magenta ink dot made of magenta ink, a cyan ink dot made of cyan ink, and a blended-black dot made of said yellow, magenta, and cyan ink are positioned in an alternating sequence.

7. An ink jet head drive circuit for driving a plurality of ink jet heads of an ink jet recording apparatus, said plurality of ink jet heads being mounted on an ink jet head mounting carriage and including first, second, and successive ink jet heads respectively using first, second, and successive color ink for making dots in first, second, and successive colors, respectively, said ink jet head drive circuit comprising:

head drive means for selectively driving said plurality of ink jet heads at a first head drive frequency;

mode selecting means for selecting a multiple-head monochrome print mode in which a monochrome print operation is performed by alternatively driving said first ink jet head and at least one of, said second and successive ink jet heads and wherein an image is formed in such a way that a dot in said first color and at least one of dots in said second and successive colors are positioned in an alternating sequence; and control means for controlling said head drive means to perform said monochrome print operation in said multiple-head monochrome print mode when said multiple-head monochrome print mode is selected by said mode selecting means, wherein each one of said plurality of ink jet heads comprises:

a plurality of nozzles for discharging ink; and a plurality of electric-to-mechanical converting devices corresponding to said plurality of nozzles, each electric-to-mechanical converting device including one electrode used as a common electrode for connecting all the electric-to-mechanical devices and another electrode used as an individual electrode for selecting a specific nozzle of said plurality of nozzles, and wherein said ink jet head drive circuit further comprises:

drive pulse generating means for continuously generating sets of different drive pulses for driving said plurality of ink jet heads differently; and drive pulse selecting means for selecting at least one pulse from among said different drive pulses included in each one of said sets and for applying said at least one selected pulse to the corresponding one of said plurality of electric-to-mechanical converting devices, wherein a delay time between adjacent pulses among said n different drive pulses is represented by an equation:

$$T_{d(k)}=(1/V_{i(k)}-1/V_{i(k+1)})\times d$$

where k is a number variable from 1 to (n−1), $T_{d(k)}$ is a delay time between a k-th drive pulse and an immediately following drive pulse, $V_{i(k)}$ is a speed of ink droplets when one of said plurality of ink jet heads is driven at a k-th drive pulse of said n different drive pulses, and d is a distance between surfaces of said plurality of nozzles and a surface of a recording sheet on which said dots are formed.

8. An ink jet recording apparatus, comprising: a plurality of ink jet heads, comprising:

a plurality of nozzles for discharging ink; and a plurality of electric-to-mechanical converting devices corresponding to said plurality of nozzles, each electric-to-mechanical converting device including one electrode used as a common electrode for connecting all the electric-to-mechanical devices and another electrode used as an individual electrode for selecting a specific nozzle of said plurality of nozzles, and wherein said ink jet recording apparatus further comprising:

first moving means for moving said plurality of ink jet heads in a main scanning direction;

second moving means for moving a recording sheet, on which said plurality of ink jet heads form dots, in a sub-scanning direction;

drive pulse generating means for continuously generating sets of n different drive pulses for driving said plurality of ink jet heads differently;

drive pulse selecting means for selecting at least one pulse from among said n different drive pulses included in each one of said sets and for applying said at least one selected pulse to corresponding one of said plurality of electric-to-mechanical converting devices; and pixel forming means for forming a pixel of n-dot times h-dot by repeating h times an operation in which said drive pulse selecting means selects said n different drive pulses and applies said n different drive pulses to said corresponding one of said plurality of electric-to-mechanical converting devices, said n different drive pulses being generated by said drive pulse generating means so as to form n different sized dots in a line in said main scanning direction within a pixel, and said second moving means moves said recording sheet for a distance of a dot pitch.

9. The ink jet recording apparatus according to claim 8, wherein a delay time between adjacent pulses among said n different drive pulses is represented by an equation:

$$T_{d(k)}=Gp/(n\times V_c)+(1/V_{i(k)}-1/V_{i(k+1)})\times d$$

where n is an arbitrary number and represents a number of different drive pulses, k is a number variable from 1 to (n−1), $T_{d(k)}$ is a delay time between a k-th drive pulse and an immediately following drive pulse, $G_p$ is a pixel pitch between adjacent pixels, $V_c$ is a head moving speed at which said plurality of ink jet heads are moving in a main scanning direction, $V_{i(k)}$ is a speed of ink droplets when one of said plurality of ink jet heads is driven at a k-th drive pulse of said f different drive pulses, and d is a distance between surfaces of said plurality of nozzles and a surface of said recording sheet on which said dots are reformed.

10. An ink jet recording apparatus, comprising:

a carriage;

a plurality of ink jet heads mounted on said carriage and including first, second, and successive ink jet heads respectively using first, second, and successive color ink for making dots in first, second, and successive colors, respectively;

a head drive control system providing signals for selectively driving said plurality of ink jet heads at a variable head drive frequency for ejecting ink droplets;

a carriage drive control system for driving said carriage at a variable carriage drive speed;

a mode selecting unit for selecting a multiple-head monochrome print mode in which a monochrome print operation is performed by alternatively driving said first ink jet head and at least one of said second and successive ink jet heads, wherein an image is formed in such a way that a dot in said first color and at least one of dots in said second and successive colors are positioned in an alternating sequence; and a controller for controlling said head drive control system to perform a monochrome print op e ration in said multiple-head monochrome print m ode and to adjust said variable head drive frequency from a first level to a second level which is equal to or lower than said first level and for controlling said carriage drive system to adjust said variable carriage drive speed from a first level to a second level which exceeds said first level, when said multiple-head monochrome print mode is selected by said mode selecting unit, wherein said first, second, and successive color inks are black, yellow, magenta, and cyan, respectively, and during said monochrome print operation in said multiple-head monochrome print mode, said controller controls said head drive system to drive said ink jet heads to successively form dots in such a way that a black ink dot made of said black ink, a yellow ink dot made of yellow ink, a magenta ink dot made of magenta ink, and a cyan ink dot made of cyan ink, and a blended-black dot made of the yellow, magenta and cyan ink are positioned in an alternating sequence, and said controller controls said carriage drive system to drive said carriage at said second level of said variable carriage drive speed which is twice as fast as said first level of said variable carriage drive speed.

11. An ink jet recording apparatus, comprising:

a plurality of ink jet heads, comprising:

a plurality of nozzles for discharging ink; and a plurality of electric-to-mechanical converting devices corresponding to said plurality of nozzles, each electric-to-mechanical converting device including one electrode used as a common electrode for connecting all the electric-to-mechanical devices and another electrode used as an individual electrode for selecting a specific nozzle of said plurality of nozzles, and wherein said ink jet recording apparatus further comprising:

a main scanning direction moving system for moving said plurality of ink jet heads in a main scanning direction;

a sheet moving system for moving a recording sheet, on which said plurality of ink jet heads form dots, in a sub-scanning direction;

a drive pulse generating system for continuously generating sets of n different drive pulses for driving said plurality of ink jet heads differently;

a drive pulse selecting system for selecting at least one pulse from among said n different drive pulses included in each one of said sets and for applying said at least one selected pulse to corresponding one of said plurality of electric-to-mechanical converting devices; and a pixel forming system for forming a pixel of n-dot times h-dot by repeating h times an operation in which said drive pulse selecting system selects said n different drive pulses and applies said n different drive pulses to said corresponding one of said plurality of electric-to-mechanical converting devices, said n different drive pulses being generated by said drive pulse generating system so as to form n different sized dots in a line in said main scanning direction within a pixel, and said sheet moving system moves said recording sheet for a distance of a dot pitch.

12. An ink jet recording method for driving a plurality of ink jet heads mounted on a carriage and including first, second, and successive ink jet heads respectively using first, second, and successive color ink for making dots in first, second, and successive colors, respectively, said method comprising:

selectively driving said plurality of ink jet heads at a variable head drive frequency;

driving said carriage at a variable carriage drive speed;

selecting a multiple-head monochrome print mode in which a monochrome print operation is performed by alternatively driving said first ink jet head and at least one of said second and successive ink jet heads, wherein an image is formed in such a way that a dot in said first color and at least one of dots in said second and successive colors are positioned in an alternating sequence; and controlling said head drive means to perform a monochrome print operation in said multiple-head monochrome print mode and to adjust said variable head drive frequency from a first level to a second level which is equal to or lower than said first level and for adjusting said variable carriage drive speed from a first level to a second level which exceeds said first level, when said multiple-head monochrome print mode is selected, wherein said first, second, and successive color inks are black, yellow, magenta, and cyan, respectively, and during said monochrome print operation in said multiple-head monochrome print mode, said ink jet heads are driven to successively form dots in such a way that a black ink dot made of said black ink, a yellow ink dot made of yellow ink, a magenta ink dot made of magenta ink, and a cyan ink dot made of cyan ink, and a blended-black dot made of said yellow, magenta, and cyan ink are positioned in an alternating sequence, and said carriage is driven at said second level of said variable carriage drive speed which is twice as fast as said first level of said variable carriage drive speed.

13. An ink jet recording method for driving a plurality of ink jet heads each comprising a plurality of nozzles for discharging ink and a plurality of electric-to-mechanical converting devices corresponding to said plurality of nozzles, each electric-to-mechanical converting device including one electrode used as a common electrode for connecting all the electric-to-mechanical devices and another electrode used as an individual electrode for selecting a specific nozzle of said plurality of nozzles, said method comprising:

moving said plurality of ink jet heads in a main scanning direction;

moving a recording sheet, on which said plurality of ink jet heads form dots, in a sub-scanning direction;

continuously generating sets of n different drive pulses for driving said plurality of ink jet heads differently;

selecting at least one pulse from among said n different drive pulses included in each one of said sets and for applying said at least one selected pulse to corresponding one of said plurality of electric-to-mechanical converting devices; and forming a pixel of n-dot times h-dot by repeating h times an operation in which said drive pulse selecting step selects said n different drive pulses and applies said n different drive pulses to said corresponding one of said plurality of electric-to-mechanical converting devices, said n different drive pulses being generated by said drive pulse generating step so as to form n different sized dots in a line in said main scanning direction within a pixel, and said second moving means moves said recording sheet for a distance of a dot pitch.

14. An ink jet recording apparatus comprising:

a carriage;

a plurality of ink jet heads mounted on said carriage and including first, second, and successive ink jet heads respectively using first, second, and successive color ink for making dots in first, second, and successive colors, respectively;

a head drive for selectively driving said plurality of ink jet heads at a variable head drive frequency;

a carriage drive for driving said carriage at a variable carriage drive speed;

a mode selector for selecting a multiple-head monochrome print mode in which a monochrome print operation is performed by alternatively driving said first ink jet head and at least one of said second and successive ink jet heads, wherein an image is formed in such a way that a dot in said first color and at least one of dots in said second and successive colors are positioned in an alternating sequence; and a controller for controlling said head drive to perform said monochrome print operation in said multiple-head monochrome print mode and to adjust said variable head drive frequency from a first level to a second level which is equal to or lower than said first level and for controlling said carriage drive to adjust said variable carriage drive speed from a first level to a second level which is slower than said first level, when said multiple-head monochrome print mode is selected by said mode selector, wherein said first, second, and successive color inks are black, yellow, magenta, and cyan, respectively, and during said monochrome print operation in said multiple-head monochrome print mode, said controller controls said head drive to drive said ink jet heads at said second level of said variable head drive frequency which is equal to or lower than a half of said first level of said variable head drive frequency to successively form dots in such a way that a black ink dot made of black ink and at least one of a yellow ink dot made of yellow ink, a magenta ink dot made of magenta ink, a cyan ink dot made of cyan ink, and a blended-black dot made of said yellow, magenta, and cyan ink are positioned in an alternating sequence.

15. An ink jet head drive circuit for driving a plurality of ink jet heads of an ink jet recording apparatus, said plurality of ink jet heads being mounted on an ink jet head mounting carriage and including first, second, and successive ink jet heads respectively using first, second, and successive color ink for making dots in first, second, and successive colors, respectively, said ink jet head drive circuit comprising:

a head drive for selectively driving said plurality of ink jet heads at a first head drive frequency;

a mode selector for selecting a multiple-head monochrome print mode in which a monochrome print operation is performed by alternatively driving said first ink jet head and at least one of, said second and successive ink jet heads and wherein an image is formed in such a way that a dot in said first color and at least one of dots in said second and successive colors are positioned in an alternating sequence; and a controller for controlling said head drive to perform said monochrome print operation in said multiple-head monochrome print mode when said multiple-head monochrome print mode is selected by said mode selector, wherein each one of said plurality of ink jet heads comprises:

a plurality of nozzles for discharging ink; and a plurality of electric-to-mechanical converting devices corresponding to said plurality of nozzles, each electric-to-mechanical converting device including one electrode used as a common electrode for connecting all the electric-to-mechanical devices and another electrode used as an individual electrode for selecting a specific nozzle of said plurality of nozzles, and wherein said ink jet head drive circuit further comprises:

a drive pulse generator for continuously generating sets of different drive pulses for driving said plurality of ink jet heads differently; and a drive pulse selector for selecting at least one pulse from among said different drive pulses included in each one of said sets and for applying said at least one selected pulse to the corresponding one of said plurality of electric-to-mechanical converting devices, wherein a delay time between adjacent pulses among said n different drive pulses is represented by an equation:

$$T_{d(k)}=(1/V_{i(k)}-1/V_{i(k+1)})\times d$$

where k is a number variable from 1 to (n−1), $T_{d(k)}$ is a delay time between a k-th drive pulse and an immediately following drive pulse, $V_{i(k)}$ is a speed of ink droplets when one of said plurality of ink jet heads is driven at a k-th drive pulse of said n different drive pulses, and d is a distance between surfaces of said plurality of nozzles and a surface of a recording sheet on which said dots are formed.

16. An ink jet recording method comprising steps of:

providing a plurality of ink jet heads mounted on a carriage and including first, second, and successive ink jet heads respectively using first, second, and successive color ink for making dots in first, second, and successive colors, respectively;

selectively driving said plurality of ink jet heads at a variable head drive frequency;

driving said carriage at a variable carriage drive speed;

a mode selecting step for selecting a multiple-head monochrome print mode in which a monochrome print operation is performed by alternatively driving a first ink jet head and at least one of said second and successive ink jet heads, wherein an image is formed in such a way that a dot in said first color and at least one of dots in said second and successive colors are positioned in an alternating sequence; and performing said monochrome print operation in said multiple-head monochrome print mode and adjusting said variable head drive frequency from a first level to a second level which is equal to or lower than said first level and adjusting said variable carriage drive speed from a first level to a second level which is slower than said first level, when said multiple-head monochrome print mode is selected, wherein said first, second, and successive color inks are black, yellow, magenta, and cyan, respectively, and during said monochrome print operation in said multiple-head monochrome print mode, said ink jet heads are driven at said second level of said variable head drive frequency which is equal to or lower than a half of said first level of said variable head drive frequency to successively form dots in such a way that a black ink dot made of black ink and at least one of a yellow ink dot made of yellow ink, a magenta ink dot made of magenta ink, a cyan ink dot made of cyan ink, and a blended-black dot made of said yellow, magenta, and cyan ink are positioned in an alternating sequence.

17. An ink jet head drive method for driving a plurality of ink jet heads of an ink jet recording apparatus, said plurality of ink jet heads being mounted on an ink jet head mounting carriage and including first, second, and successive ink jet heads respectively using first, second, and successive color ink for making dots in first, second, and successive colors, respectively, said ink jet head drive method comprising:

selectively driving said plurality of ink jet heads at a first head drive frequency;

selecting a multiple-head monochrome print mode in which a monochrome print operation is performed by alternatively driving said first ink jet head and at least one of, said second and successive ink jet heads and wherein an image is formed in such a way that a dot in said first color and at least one of dots in said second and successive colors are positioned in an alternating sequence; and performing said monochrome print operation in said multiple-head monochrome print mode when said multiple-head monochrome print mode is selected by said mode selecting step, wherein each one of said plurality of ink jet heads comprises:

a plurality of nozzles for discharging ink; and a plurality of electric-to-mechanical converting devices corresponding to said plurality of nozzles, each electric-to-mechanical converting device including one electrode used as a common electrode for connecting all the electric-to-mechanical devices and another electrode used as an individual electrode for selecting a specific nozzle of said plurality of nozzles, and wherein said ink jet head drive method further comprises:

continuously generating sets of different drive pulses for driving said plurality of ink jet heads differently; and selecting at least one pulse from among said different drive pulses included in each one of said sets and for applying said at least one selected pulse to the corresponding one of said plurality of electric-to-mechanical converting devices, wherein a delay time between adjacent pulses among said n different drive pulses is represented by an equation:

$$T_{d(k)}=(1/V_{i(k)}-1/V_{i(k+1)})\times d$$

where k is a number variable from 1 to (n−1), $T_{d(k)}$ is a delay time between a k-th drive pulse and an immediately following drive pulse, $V_{i(k)}$ is a speed of ink droplets when one of said plurality of ink jet heads is driven at a k-th drive pulse of said n different drive pulses, and d is a distance between surfaces of said plurality of nozzles and a surface of a recording sheet on which said dots are formed.

* * * * *